US012324943B2

(12) United States Patent
Sapoznick

(10) Patent No.: US 12,324,943 B2
(45) Date of Patent: Jun. 10, 2025

(54) WEIGHT TRAINING CHAIN APPARATUS AND METHOD OF USE

(71) Applicant: Nickolas Robert Sapoznick, Edmonds, WA (US)

(72) Inventor: Nickolas Robert Sapoznick, Edmonds, WA (US)

( * ) Notice: Subject to any disclaimer, the term of this patent is extended or adjusted under 35 U.S.C. 154(b) by 220 days.

(21) Appl. No.: 18/113,603

(22) Filed: Feb. 23, 2023

(65) Prior Publication Data

US 2023/0264063 A1 Aug. 24, 2023

Related U.S. Application Data

(60) Provisional application No. 63/313,448, filed on Feb. 24, 2022.

(51) Int. Cl.
*A63B 21/06* (2006.01)
*A63B 21/065* (2006.01)
*A63B 71/14* (2006.01)

(52) U.S. Cl.
CPC ..... *A63B 21/0609* (2013.01); *A63B 21/065* (2013.01); *A63B 71/141* (2013.01); *A63B 2220/833* (2013.01)

(58) Field of Classification Search
CPC . A63B 21/0609; A63B 21/065; A63B 71/141; A63B 2220/833; A63B 21/4019; A63B 24/0062; A63B 71/0622; A63B 21/0724; A63B 2071/0694; A63B 2209/10; A63B 2220/20; A63B 2220/30; A63B 2220/40; A63B 2225/09; A63B 2225/50
See application file for complete search history.

(56) References Cited

U.S. PATENT DOCUMENTS 8,540,611 B1 * 9/2013 Barr ..... A63B 21/16 482/121
2016/0310781 A1 * 10/2016 Dallstream ..... A63B 21/0609

FOREIGN PATENT DOCUMENTS

CA 3073265 A1 * 8/2021 ..... A63B 21/0609

* cited by examiner

*Primary Examiner* — Megan Anderson
*Assistant Examiner* — Juan Carlos De Leon Diaz
(74) *Attorney, Agent, or Firm* — Apex Juris, pllc; Tracy M Heims

(57) ABSTRACT

A weight training apparatus having at least one main chain having a series of interconnected segments, at least one connection marker at specified segments on the at least one main chain, at least one tangent chain, at least one tangent chain connector to connect the at least one tangent chain to the at least one main chain, at least one data hub, at least one data processor, and at least one data communicator.

20 Claims, 33 Drawing Sheets

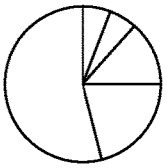

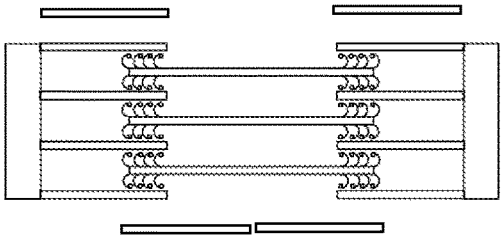

Example A2. Corresponding bicep curl length tension relationship

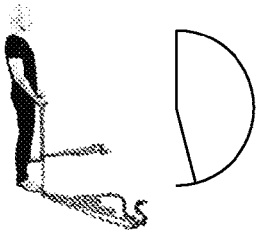

Example A1. Fully lengthened sarcomere at mechanical disadvantage

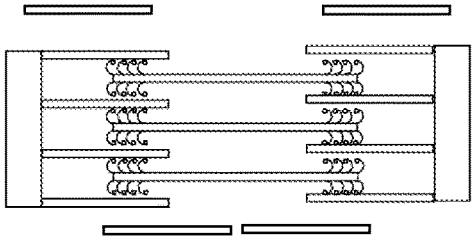

Example B2. Corresponding bicep curl length tension relationship

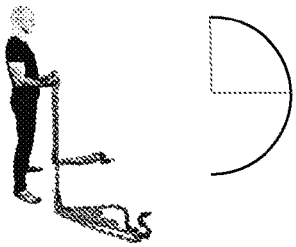

Example B1. More contracted (cross bridged) than Example A2 with more mechanical advantage

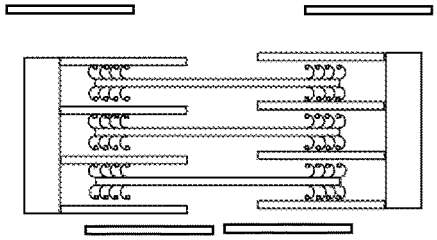

Example C2. Corresponding bicep curl length tension relationship

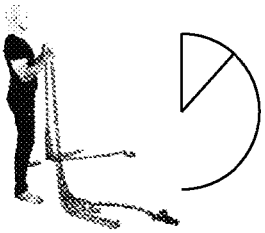

Example C1. More contracted than Example B1 with more mechanical advantage

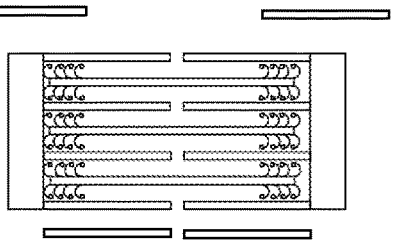

Example D2 corresponding bicep curl length tension relationship

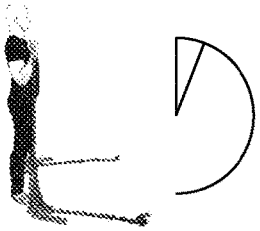

Example D1. More contracted than Example C1 with more mechanical advantage

Fig. 1

WEIGHT TRAINING CHAIN APPARATUS AND METHOD OF USE

RELATED APPLICATIONS

This application claim priority to Provisional Patent No. 63/313,448, filed on Feb. 24, 2022. All matter in that application is incorporated herein by this reference.

BACKGROUND OF THE INVENTION

Field of the Invention

This invention relates to weight training and training methods, specifically, using a chain, tangent chains, and smart chain devices, a Micro Data Plaque and Data Emitter to article, including a gloved chain attaching device equipment meant to utilize the chain apparatus, all designed and used to increase strength.

Background of the Invention

Weights are currently used for lifting and, generally speaking, with the exception of a few systems that use bands, bendable bars or rods, the weight used during lifting is consistent. In other words, weight is constant and is not increased throughout the lift. Currently, when using weights, a person who is performing a bench press loads matching weights on each side of the bar and proceeds to lift. The same steps are taken for virtually every exercise, and relatively the same for cable exercises. In order to record and keep track of what was lifted, how it was lifted, when it was lifted, etc. after the exercise is finished the lifter manually writes down or records the number of repetitions performed, the weight lifted and any other data that might be usable to the lifter. This is true for every other exercise performed, such as curls, squats, shoulder press, or any other imaginable lift. This recording system is time consuming, cumbersome, and inaccurate.

There are several systems that use resistance bands and provide muscle resistance created by elastic force. When a user pulls on the band, the user creates tension, and muscles must work harder to continue the movement. The more the band is stretched, the greater the resistance it provides, and that means that muscles have to work that much harder to pull against the increasing resistance. These systems have several drawbacks, First, there is no way to know exactly how much resistance is created by the apparatus and furthermore, there is no way to know the acceleration of resistance throughout the apparatus in respect to a muscle action's natural arc length or use of energy or resistance. Second, bands tend to stretch so the resistance provided one week may not be the same as the next week or even the next day. The same is true for bendable rods. Because the resistance changes the lifter cannot know how much resistance is given at any given lift, Thirdly, because it is a "stretch" there is no conventional way to calculate the amount of stretch. Next, there is no way to record the workout in respect to such resistance acceleration; there is no way to record the user's progress; and no conventional way to know exactly how much additional resistance is applied as the band is stretched. Finally, there is no way to accurately track or digitally track, store and utilize data from a workout or past workouts.

Plain chains are currently used for lifting and chains apply some of the same principles utilized by resistance bands. Bands and chains are tools that make exercises lighter in the bottom position and heavier (greater resistance), in the top position, or initial position versus maximal contraction position. This is known as "accommodating resistance." Bands and chains help you build size and strength faster because you can overload different parts of the exercise and create maximum muscle tension at different joint angles, Currently when chains are employed there is one main chain that is added to the side of a given bar and that is then used to increase the weight as the bar is lifted. The current method of increasing the weight is to add more chains, but with the typical common method the chains are all added at the same point on the main chain, and when they are distributed (if someone takes the time) there is a less than optimum advantage due to the time necessary to count, so as to more accurately place such attachments/connections chains. The current novel lifting apparatus was developed to provide more adjustability to the presently available systems and to provide a way to record and track a user's progress. In addition, because the chain weight remains constant the lifter can actually know exactly how much weight is added to each lift and that makes recording easier.

Although similar systems exist, there are still none that provide the unique aspects of the present invention, along with the unintuitive utility features, such as specific placement and specific measuring paired with a Micro Data Plaque and or, a Data Emitter, an icon or symbol, an emitter or a digital interface using data units or data devices that are attached, incorporated into, or nested in chain data cradles. The utility of this system is enhanced by a notation called the Roberts Notation that is meant to be used along with the Roberts Smart Chain System for recording and indexing measurements and for tangent chain placement along the main chain.

Currently there are phone apps and other digital programs that allow users to track their workouts, but they are clumsy, difficult to navigate, require user input after each exercise and are sometimes expensive to use. The current system is easy to use, is pre-programmable with the apparatus and can track the user's workout and workout histories automatically. When not preprogrammed the apparatus is customizable and can be fitted with either the Micro Data Plaque and the Data Emitter, or an information displaying data unit or piece.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF SUMMARY OF THE INVENTION

In view of the foregoing it is an object of the present invention to provide a weightlifting system and training system that includes a way to systematically increase weight throughout a lift and to accurately measure and record a training session using a data emitter or interface that conveys and communicates information from a data hub to a data processor, compiling the data and then having the compiled data visible at a data communicator. The main apparatus used in the training system of the present application is a customizable main chain within the system called Roberts Smart Chain. The Roberts Smart Chains are composed of welded chain links embodying data hubs at, but not limited to at least multiples of, for example, 5× and 10× measured and identified links, properly measured and marked at multiples of 5× and 10×, and therefore effectively useable for identically repeatable assembly of customizable chain "tree" setups for general fitness equipment. The system may also be used with at least one standard or Reversible Kruger Glove, designed to specifically target groups of muscles.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the inventive subject matter.

FIG. 1 is examples A through D shows images of the sarcomere and the corresponding bicep curl length tensions relationships.

FIG. 9A, FIG. 9B, FIG. 9C, FIG. 9D are diagrams that show the accumulation of interaction from two muscles contractions with the application of a Roberts Smart Chain tree, starting in example (a) and ending in example (m). This diagram shows the nonlinear accumulation of a contraction with chains reaching a range of 10 to 26 seen example (m) of FIG. 9D.

DETAILED DESCRIPTION THE INVENTION

The disclosed subject matter will become better understood through review of the following detailed description in conjunction with the FIGS. The detailed description and FIGS. provide example embodiments of the invention described herein. Those skilled in the art will understand that the disclosed examples may be varied, modified, and altered without departing from the scope of the invention described herein.

Throughout the following detailed description, various examples of the Roberts Smart Chain and embodiments thereof are disclosed. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature or example.

The invention will now be described in detail with reference to the attached drawings. As described above in the summary there is a need for a weightlifting apparatus and system that will help a user build strength and muscle faster, and, more specifically, target resistance through a progressive, customizable "time under tension" system.

Figure 2:
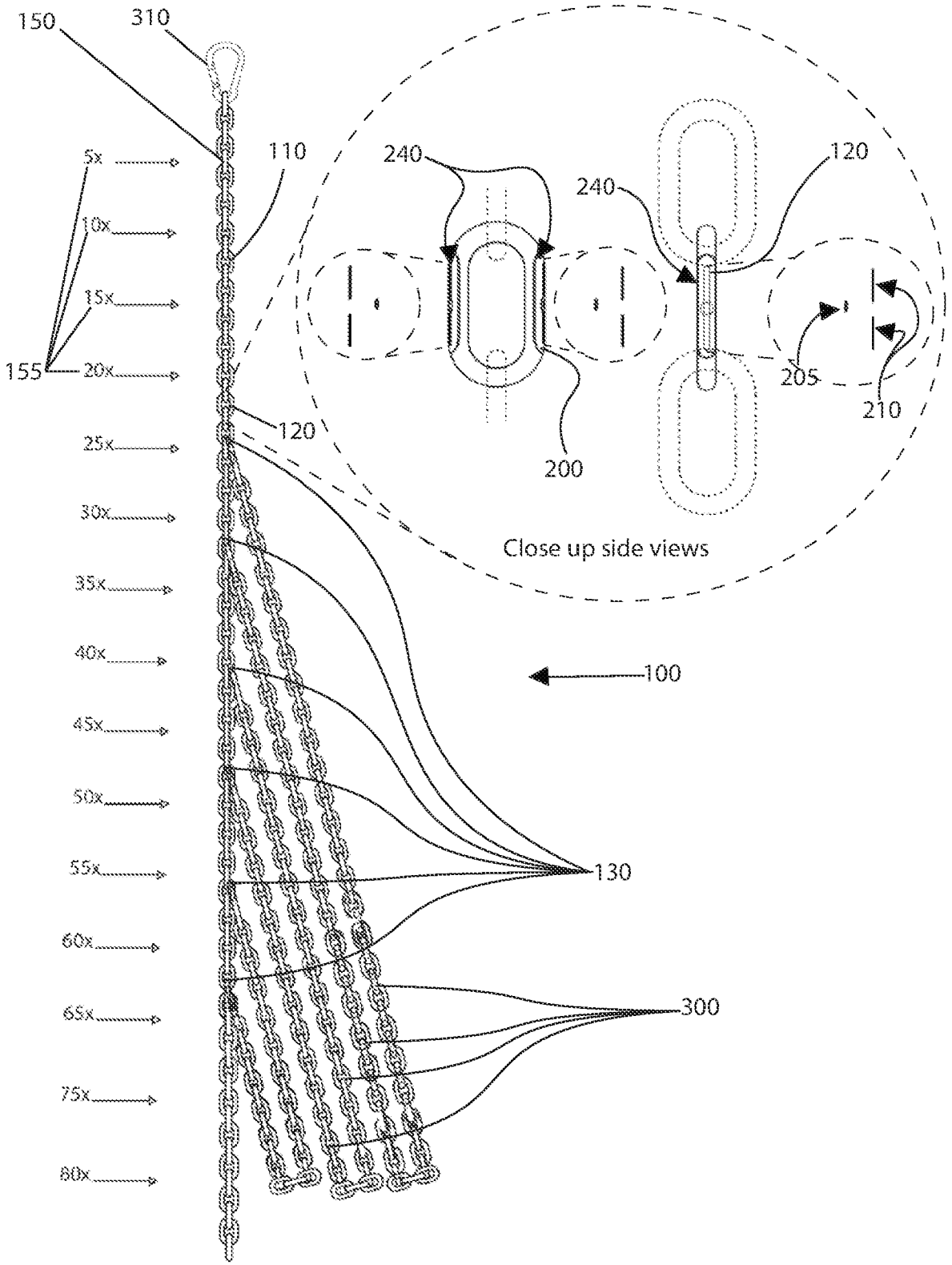
FIG. 2 is a Roberts Chain system shown with tangents of chain attached.

This invention relates to a weight training apparatus and methods of training using this apparatus, specifically, using a series of chains that are designed and used to increase strength. The weight training apparatus in a first preferred embodiment has at least one main chain 110 having a series of interconnected segments 120, at least one connection marker 150 at specified segments 130 on the at least one main chain 110, at least one tangent chain 300, at least one tangent chain connector 310 to connect the at least one tangent chain 300 to the at least one main chain 110, at least one data hub 210, at least one data processor 220, and at least one data communicator 230. This embodiment is shown in FIG. 2. The main chain 110 is used to measure and support the addition or attachment of progressive resistance tangent chains.

The Roberts Smart Chains 100 are a type of exercise, training and measuring chain system having a main chain 110 with specific marks, preferably at links of multiples of 5 and multiples of 10 that can receive the tangent chains 300 that provide an easy method to record workouts. The Roberts Smart Chain System 100 is used for resistance training with specific measurement qualities, like a ruler, for heavy duty environments requiring durability. That is, it is durable for tough conditions, such as for weight training.

When in use there are multiple, different exercises that can utilize the Roberts Smart Chain system 100. In some, such as a single arm curl, the user would use the main chain 110 and then progressively attach the tangent chains 300 to increase the load. Alternatively, the user could use the chain system to perform a bench press, where a main chain 110 is added to each side of the lifting bar and then the user would again progressively attach the tangent chains 300 to each side of the lifting bar to increase weight. Tangent chains 300 are connectable to the main chain with a tangent chain connector 310. The tangent chain connector can be a carabiner, a clip, a hook, a spring-loaded clip, or any other apparatus that can easily and conveniently connect the tangent chain to the main chain. The tangent chain 300 is preferably connected to the main chain 110 at one of the connection markers 150. The purpose of the connection markers 150 are to correctly identify positions on the main chain 110 for correct attachment of the tangent chains 300 to the main chain 110, including but not limited to human visual identification of the measured links, preferably at multiples of 5 and multiples of 10. The purpose of the attached chains or tangent chains 300 is to increase resistance through a range of motion. The tangent chains 300 attached to the main chain 110 are important and crucial for increased muscle development.

In one embodiment the chain is made from metal and the connection marker 150 is marked with an identifier. The connection markers 150 are placed along the main chain 110 and should be readily viewable and decipherable by a user. This is easily accomplished by lettering, symbols, digital symbols, color marking or coded markings, such as with a QR code or other digital information source, or any other type of marking that establishes and easily identifies the connection marker 150. It is also preferable to abrade, scratch or rough up the surface of the metal at the marker. This abrading or roughing of the surface is crucial for the process of adhering paint to the metal for durability of the product and to withstand heavy impact situations. Simply applying paint to the metal is ineffective as it tends to easily rub or chip off the surface. When the metal surface is abraded the paint more readily adheres to the metal. The marked points are used to identify the length of the chain or a point on the chain from a reasonable distance for recording placement of the tangent 300 chains on the Roberts Smart Chain main chain 110. The markings related to coded symbols or lettering may be secured in a nestable recessed cradle like area able to hold various data units of a variety of ability and purpose.

The following is a more detailed description of the above-described Roberts Smart Chain system and how and why it works. The connection markers 150 are preferably easily and clearly marked at multiples along the chain. These markers can be at any multiple, but it is preferable that they be at multiples of 5 and 10, or 6 and 12. In this submission they will be discussed for example as multiples of 5 and 10. There are measuring links, one type at multiples of 5× and another at multiples of 10×, all along the length of the main chain 110. After the fourth link, at the placing of the fifth link, there is an identifiably different fifth link that is at least equal in function to the other links. At the tenth link there is a link that is different from the first 1-9 links, this tenth link is at least equal in functionality to the other links. The multiples of 5 will be "like or identically colored" and there is no limit to the color used to differentiate these links. The multiples of five will be identical to each other in function and have, but not limited to, a Nesting Data Cradle. Also, the multiples of 10 are "like or identically colored" and are equally identifiable from the links between the multiples of fives and tens and vice versa. The multiples of ten will be identical to each other in function and have, but not limited to, a Nesting Data Cradle. Also, the links between multiples of tens and fives and the multiples of fives and tens will be identical to each other in function and have, but not limited to, a Nesting Data Cradle, different from the multiples of ten. The multiples of 5 and multiples of 10 are not identically colored and are opposingly colored unless the user specifies a custom order color. In FIG. 2 there is a diagram that includes an example of tangents placed on the Roberts Smart Chain to form an arbitrary chain tree. There are first tangent insertion points that are arbitrarily positioned at f24 and f32. Second tangents are then inserted arbitrarily at f40 and f49. Third tangents are next set at insertion points f56 and f64. Additional tangents may be inserted as needed. Finally, at the end of the main chain 110 is a looped end where all the tangent chains 300 are attached, as shown in FIG. 2.

The Roberts Smart Chain System 100 can be used to measure resistance, length, and placement informally by identifying the marked links and using them as a way to count the placement or value of resistance and or length. The tangent chains 300 can be attached to the Roberts Smart Chain 100 main chain 110 for exercise, such chains (as described in the Roberts Smart Chain Methodology) are Regular Tangents, Phi Tangents and can be made from arbitrary, loose, regular industrial chain. A purpose of the attached chains or "tangent chains" is, but not limited to, increased resistance through a range of motion or length for multiple exercise applications. For exercise, the tangents provide increased resistance. By using the Roberts Smart Chains 100 as described a user can rely on the marked links to provide specific and accurate measuring points from afar, such as a mirror across a gym. A plain industrial chain, as is currently used for chain lifting exercise, is bare, with no accurately measured marks and is time consuming to count chain links and therefor counterproductive to many exercise types. To hand count 'one by one', when an exercise's tangent may be best placed at a number further from the first link position, is also time consuming.

Many strength training responses are time sensitive to achieve the desired physiological results, such as hypertrophy for increased muscle size for purposes of energy storage, or personal preference of desiring a larger, athletic appearance. Hypertrophy training is a time sensitive physiological conditioning program that increases predominately the amount of glycogen stored in the muscle, making it larger after proper normal recovery. The "Roberts Notation" can be used along with the Roberts Smart Chain 100 to easily record information about an exercise's specific placement of tangents either by the user or by someone monitoring the activity during time sensitive situations such as hypertrophy, and other exercise modalities that can also be time sensitive, like cardiorespiratory training or general athletic conditioning. Another advantage of the Roberts Smart Chain is to measure correctly and in a timely repeatable manner the increased resistance after the motion has already begun in total or a percentage or portion of the distance of a given exercise. A tangent chain, for example, can be added at any point on a main chain throughout the physical range of an exercise to determine an effect of such different resistances and the following recovery of such different efforts. This allows a fitness professional to determine differences such as, if the increase of resistance effects the muscle prime mover or if the tangent effects the support muscles, and where upon the range of motion the difference or effect takes place. This allows generally anyone to visually see and record at which point a chain becomes one chain, link, size, or gauge too much or too many and at which point and angle.

FIG. 5 shows the Roberts Smart Chain 100 main chain 110 on the left. At the top of the main chain 110 is the first or beginning link of the Roberts Smart Chain on the main chain 110. This first link is, but not limited to, abraded, or imprinted, or etched, to a specific design that can be associated with a specific manufacturing process such that it may be identified from other manufacturers by but not necessarily a serial number or identifying mark. The fifth link thereafter represents the first multiple of fives where each multiple of five are each marked uniquely different from the standard manufactured chain so that the user can easily differentiate the 5's from the standard chain. Likewise, each tenth length is uniquely marked with a color or marking so that the user can differentiate these links from the others. Thus, the $5^{th}$ and $10^{th}$ lengths are marked differently so that the user can easily see which lengths are different from the standard chain. It should be noted that multiples of 5 is used simply as an example and that any multiple may be used for the system to work effectively. That is, it is not limited or restricted to multiples of 5. It could be multiples of 2, 3, 4, 5, 6, or whatever the user wants to use.

FIG. 1 shows a simple version of the natural movement of a sarcomere's mechanics outlined in the Sliding Filament Theory (a fundamental theory accepted in anatomy and physiology of how muscles contract). The muscles contract mechanically on a cellular level. FIG. 1 is a basic sarcomere contraction showing limits of force production, such as when contraction ends due to physical entropic limits of muscle contractile force. A sarcomere is defined as the segment between two neighboring, parallel Z-lines. Z lines are composed of a mixture of actin myofilaments and molecules of the highly elastic protein titin crosslinked by alpha-actinin. Actin myofilaments attach directly to the Z-lines, whereas myosin myofilaments attach via titin molecules. A sarcomere is a structural unit of a myofibril tissue in striated muscle. The sarcomere is the fundamental unit of contraction and is defined as the region between the two Z-lines. Each sarcomere consists of a central A-band (thick filaments) and two halves of the I-band (thin filaments). The I-band from two adjacent sarcomeres meets at the Z-line. FIG. 1 shows how the sarcomere works with respect to the present invention. Sarcomere contraction is supported by troponin leavers contracting towards and with the sodium port channels but is only discussed here as indexes of information of interaction of muscle contraction, shown numerically in FIG. 7 and counted numerically as points of interaction and simplified to a range of only five points of interaction to be recorded for the example. The example displayed in FIG. 1 is counted as an over simplified index of interaction in FIG. 7 as only the natural index of interaction between the actin and myosin in a cross-bridge contraction. An example of a cross bridge action between this index counted, but instead, with chains and tangents is counted in the example in FIG. 9. When compared the examples of FIG. 6A exposited through FIG. 7C show a great difference in the range of values counted as points of interaction. In the examples in FIG. 6B compared to FIG. 6C one can clearly see a greater footprint on the graph in the diagram illustrated in FIG. 6C that illustrates an example of with the chains and tangents displayed in FIG. 9. This example can be seen again in the graphs showing the difference of without chain in example FIG. 8*b* versus with chain in FIG. 8*c*.

Figure 6A:
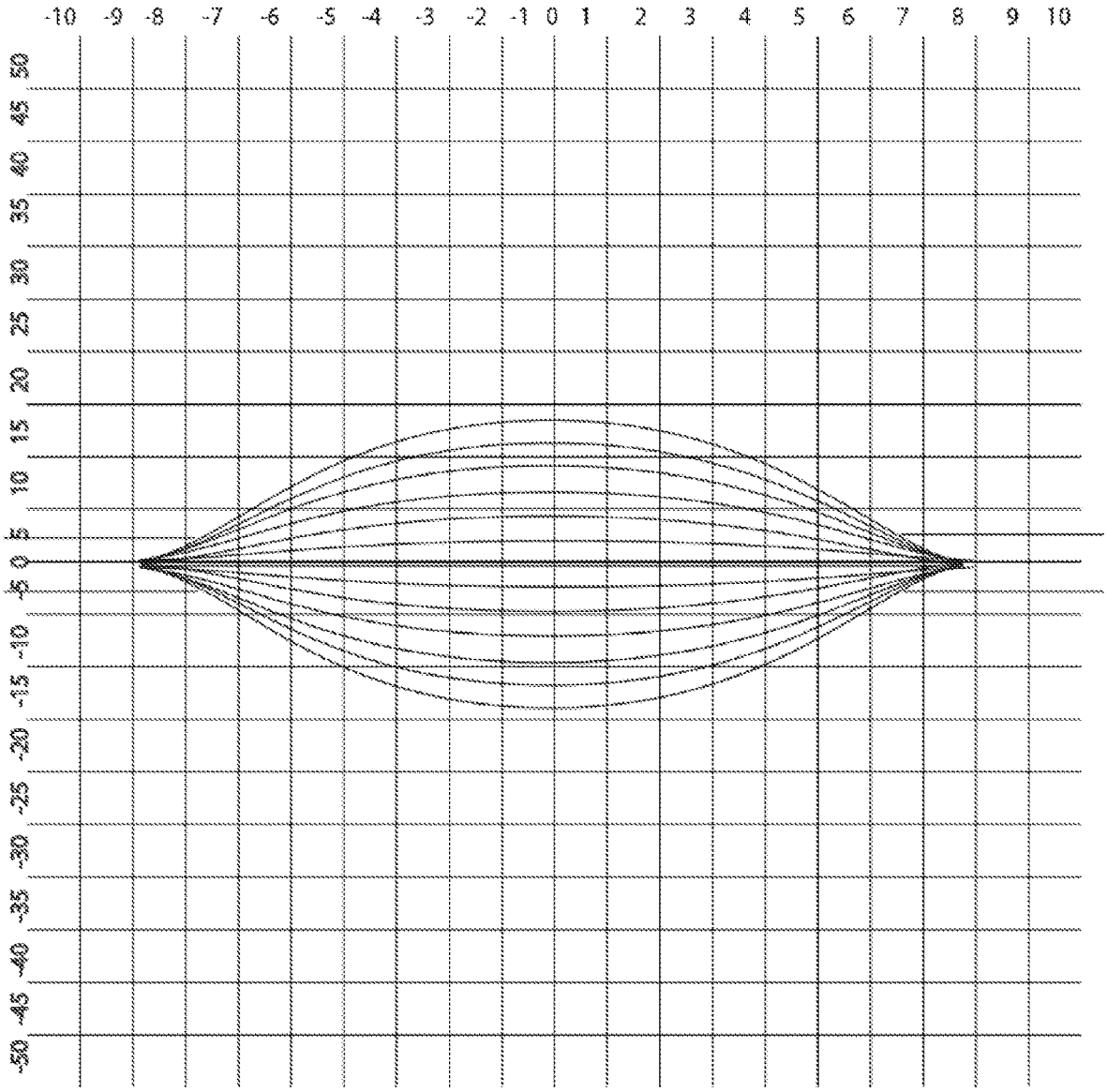
FIG. 6A is a generalization of the interaction of actin and myosin as the cross bridge of a sarcomere viewed as a graph of a muscle. When muscles contract, they cross bridge. The generalized figure is in respect to the limits of the interaction the muscles sarcomere naturally accumulates in two contractions. When this limit is accumulated into columns, they have a curve like a muscle.
Figure 6B:
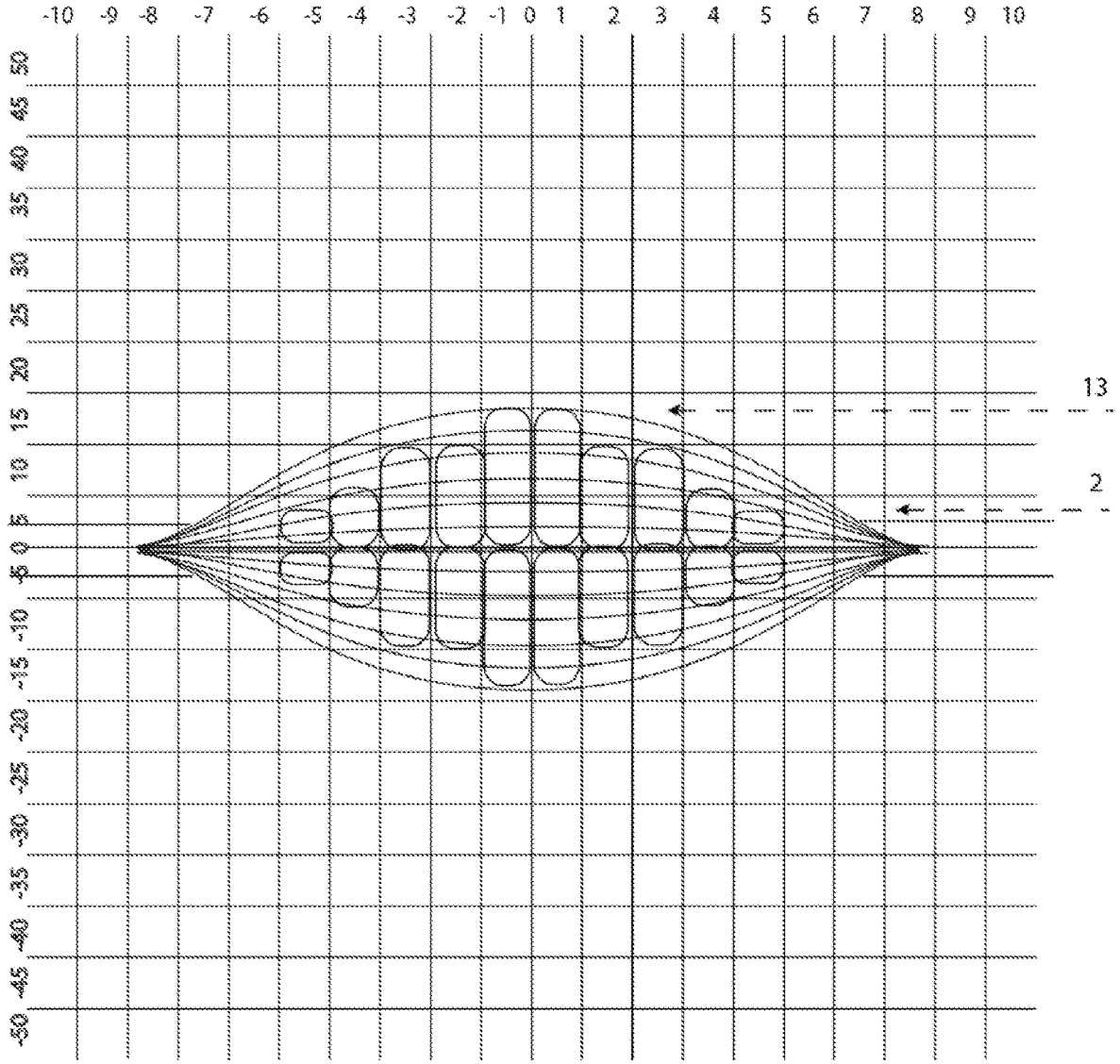
FIG. 6B is the graph from FIG. 6A with the representation of points of interaction accumulated in columns moving away from the center shown as blocked out columns to show the natural index accumulated in a pair of muscle contractions that have an interaction point accumulation range of 2 to 13.
Figure 6C:
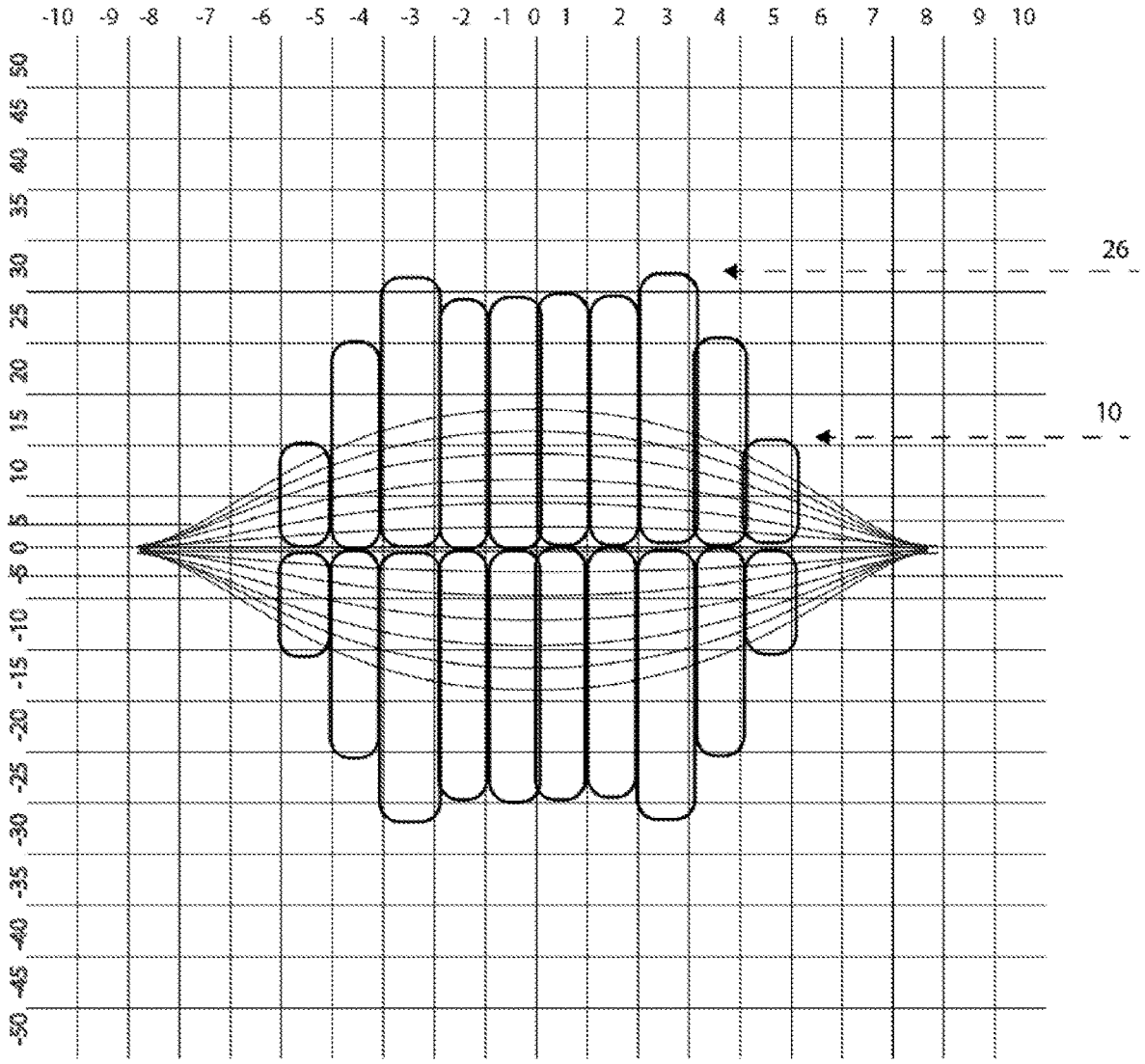
FIG. 6C is a graph from FIG. 6A with the representation of points of interaction accumulated in columns moving away from the center shown as blocked out columns to show the natural index accumulated in a pair of muscle contractions, with the addition of a chain tree to show the difference in the natural accumulation of points of interaction versus the progressive resistance of an added Roberts Chain System that reach a range of 10 to 26.
Figure 7A:
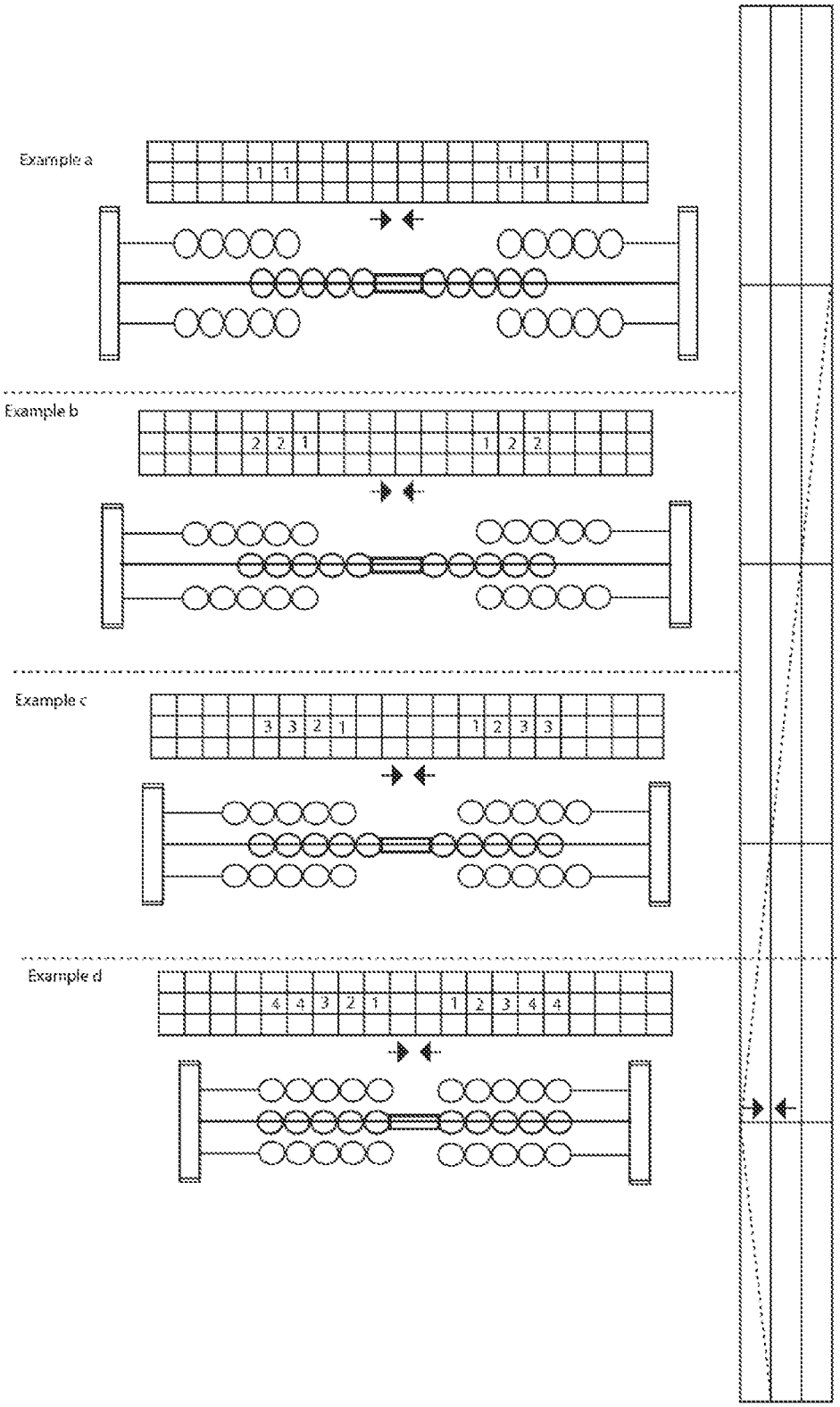
FIG. 7A, FIG. 7B, FIG. 7C, FIG. 7D are a diagrams that show the accumulation of interaction from two muscles contractions starting in example (a) and ending in example (m). This diagram shows the nonlinear accumulation of a contraction without chains reaching a range of 2 to 13 at the distal ends seen in example (m) of FIG. 7D.
Figure 7B:
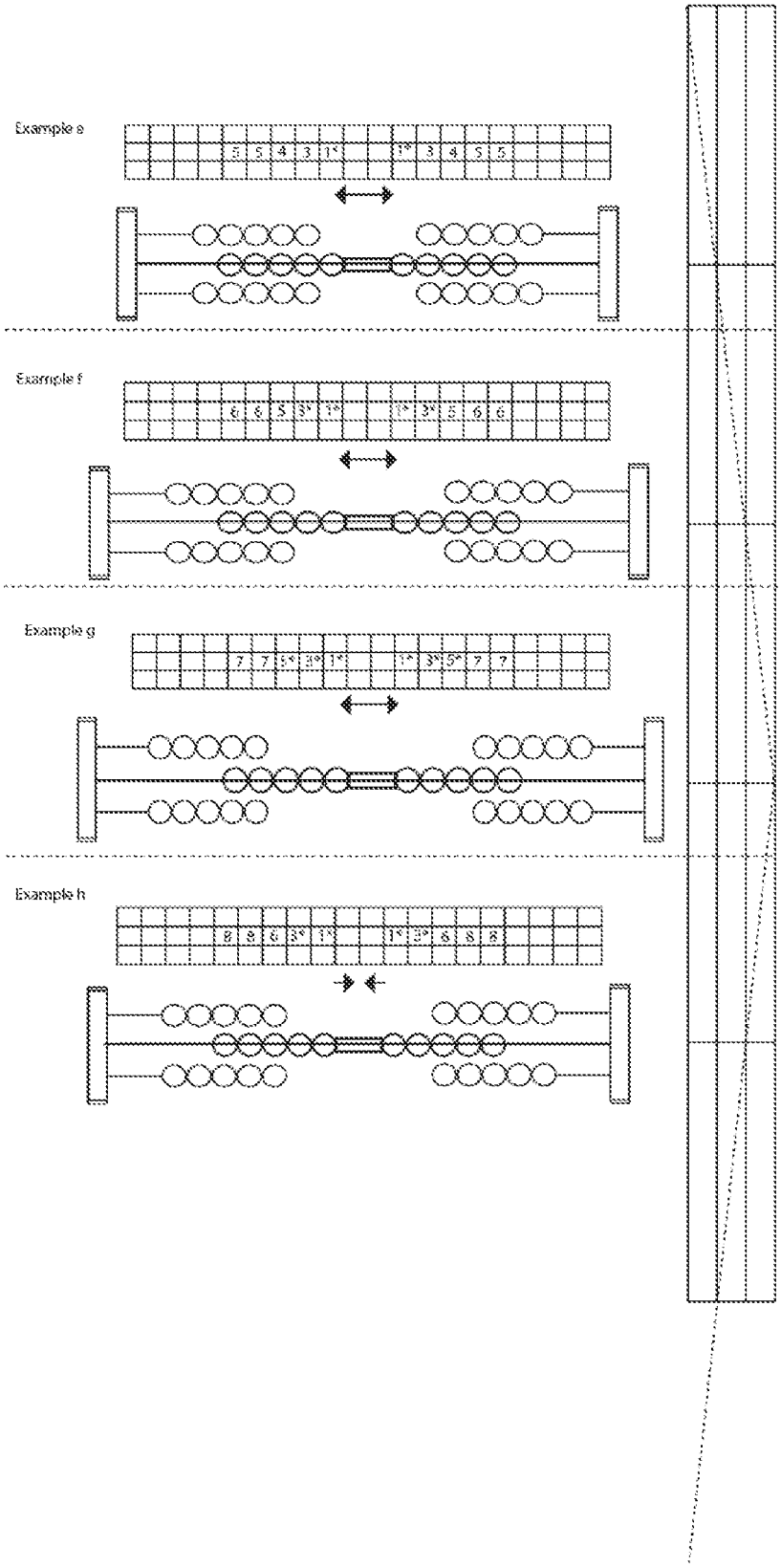
Figure 7C:
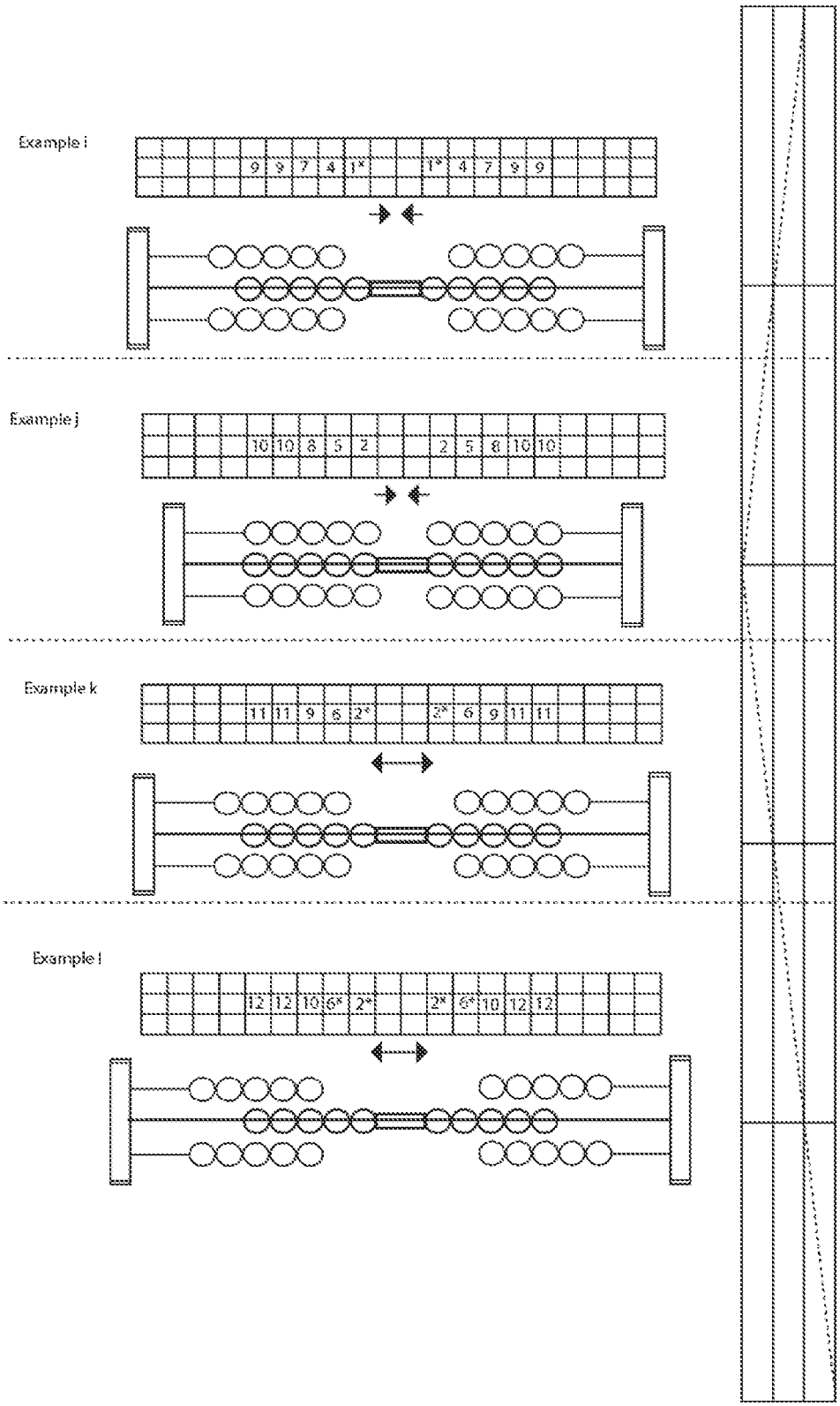
Figure 7D:
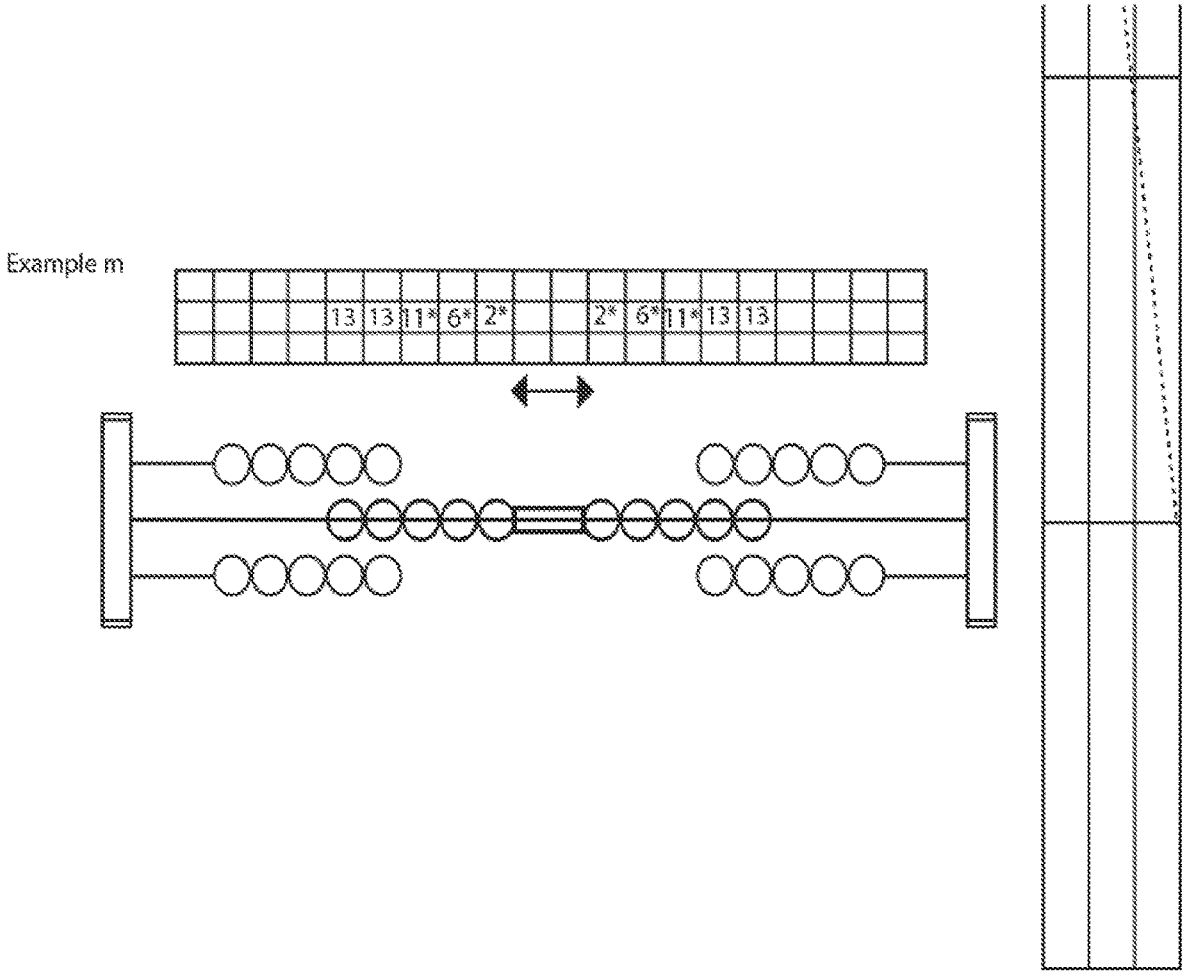

The interaction of actin and myosin is represented and accounted in FIG. 6A and FIGS. 7A, 7B, 7C and 7D. The diagram in FIG. 6A shows a rounded generalization of a muscle based on the numbers shown in FIGS. 7A, 7B, 7C and 7D. This range of interaction example of FIG. 7 is represented again in FIG. 6B. In FIG. 6B a series of rounded rectangles covering the range of 2-13 discussed as the index of interaction range. FIG. 6C shows the same index but with consideration for chains attached and accounting for additional points of interaction along with the natural index, shown with larger blocked out columns. FIG. 6C is in reference to the index accumulated in FIG. 9A, FIG. 9B, FIG. 9C, and FIG. 9D and the final count shown in FIG. 9D as the final total summation of interactions. The example in FIG. 7 from example (a) to (g) will be referred to as simply the Natural Index. The Natural index is one complete action of the sliding filament theory that begins with a simple cross bridge where there is an interaction of 1 at two points in (a) to a difference of 1 to 7 in interaction points at (g). FIG. 6A shows a representation of the index accumulated when the sarcomere finishes 2 contractions or two times of the natural index by example FIG. 7(*m*) such that the discrepancy is 2 to 13. Basic sarcomere contraction showing limits of force production due to entropic limits of muscle contractile force is shown in FIG. 1 when the sarcomere is fully contracted, and again in FIG. 7 examples (d) and (j). The muscle is extended and at a point showing a natural action for a total of one 'natural index' at FIG. 7. example (g) and a total of natural index of two at FIG. 7, example (m).

FIGS. 9A through 9D are explained as follows. The description of the accumulation of interactions is counted as follows:

Row Zero) When these numbers are vertically aligned with the circles representing actin interaction with sarcomere, an Interaction point will be added of +1 value per interaction in current example row b) directly below. This Row is identified using the + sign.

Row a) represents a Simple Accumulation of row zero) natural index of interaction, when an actin circle symbol lines up under a +1 symbol than the number is added to row a) which is summated in row c)

Row b) represents the increase in chain interaction values when the circle (actin) and sarcomere (circle with horizontal line) symbol above and below are vertically aligned the number will be added to row c) directly below. The symbol for the function of the chain is represented by lambda λ. This Row is symbolized using the fλ sign.

Row c) Relatively complex index accumulation; summation vertically of row a) and b). This Row is symbolized using the σ sign.

Row d) is a summation of the previous examples row d) and the current examples row c) for the total interaction accumulated up to the given point. This Row is symbolized using the Σ sign for summation.

Row e) The total indexed points of interaction history symbolized by final sigma iζ for total summation.

The Prime Mover Muscles, or the main muscle of an exercise, when contracting have a peek muscular/kinetic advantage near the middle of most contractions. FIG. 1 clearly shows where a mechanical advantage from such a muscular/joint's kinetic systems leverage exceeds the point of principle resistance, or rather, is no longer in an elongated or resting length, seen in FIG. 1, Examples A1 and A2 elongated and then shown in Examples D1 and D2, completely contracted, ending the potential of force utilization (this is associated with adaption in areas prone to atrophy and other physical ailments). This example begins to help show where and when chain tangents should/may be attached at specific points implemented as resistance. Because of the markings and the interactive interface Data Cradles the specificity of the tangent placement is more easily assembled and repeated to the resistance of an individual's muscle or movements curve specifications (rotation vector), and one in the same simultaneously where the interaction points on FIG. 7 indicate a disproportionate discrepancy is beginning to show in the index of interaction between FIG. 7 (examples a through g), thus showing an opportunity for a Chain Tree at some midway point (as shown in FIG. 1).

When a user is performing bicep curls, the force required to contract a muscle diminishes naturally at a higher elevation of a bicep curl's arc of motion. Because of this decrease, a user can improve on the effectiveness of the bicep curl by adding tangents to the Roberts Smart Chain main chain 110. The tangent chain 300 addition allows the user to maintain an approximately equal force requirement throughout the curl's arc of motion.

The measured link placement more accurately allows for quick and repeated assembly of a function using the Roberts Smart Chain 100 to make the Chain Tree. The Chain tree is any Roberts Smart Chain 100 with tangents 300 attached for the purpose of resistance during the exercise. Chain resistance is custom placed or accommodated to an individual's natural resistance and capacity limits at specific moments of torque or radians in consideration of muscle force versus increased leverage or muscle unit force distribution throughout an exercise's movement. The muscular force in respect to the angle of the joints determines what advantage or disadvantage the overall torque required because of the influence the arc length has on the necessary force of innervation to move not only a muscle and one's body, but in this system a main chain and series of specifically placed tangent chains to go along with whatever is considered standard for some arbitrary such exercise. This is done because a user's muscle's movements or personal ranges of motion can vary. Because of such torque, depending on the angle, leverage can be greater than is beneficial for resistance training and therefor a greater force of resistance overall applied upon the sarcomere (sliding filament theory) using the Roberts Smart Chain main chain 110 with tangent chains 300 attached has a greater threshold or range of progressive resistance to the advantage of someone lifting weights for such reason as strength training, or hypertrophic resistance training.

Reasons for different weight capacities varies for everyone. Because of one's bone length, such exercises like a bicep curl can have different effects on physiological aspects such as heart or cardio response to the same weight for different people at different ranges of contraction of muscle for a number of reasons, such as a user's arm's length (lever arm mechanical advantage) the force required for contraction and therefore, muscle innervation can vary. This can have a greater or lesser than needed threshold of reaction. This can be beneficial for people such as for those with long arms. At different ranges, or angles, the capacity of resistance can be adjusted and challenged with tangent chains and recorded with the Roberts Notation or can be digitally recorded using the current system as described above.

Figure 22:
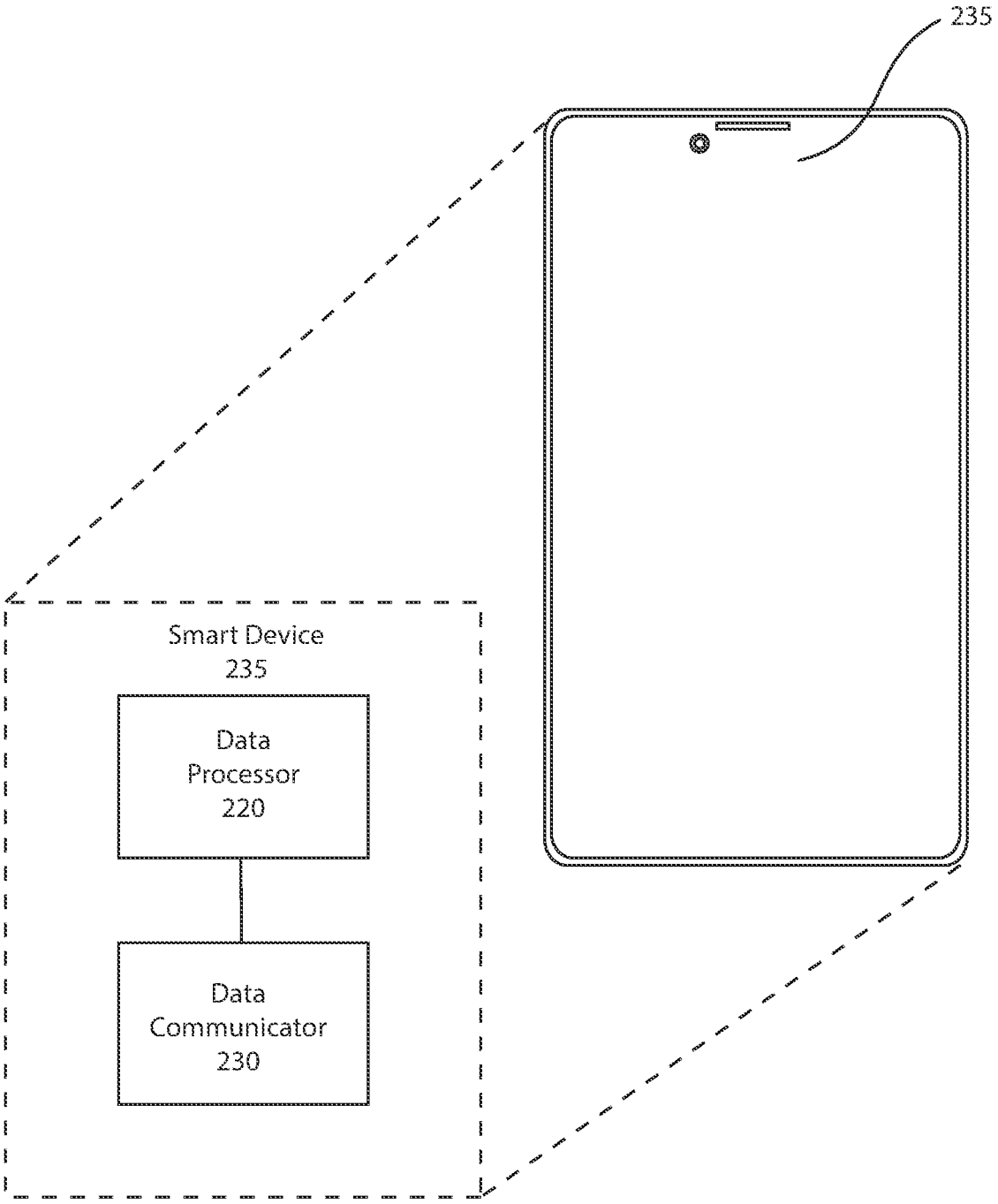
FIG. 22 is a smart device having at least a data processor and a data communicator.

FIG. 1 shows the different stages of the sarcomere when using the Chain Tree. In FIG. 1, example A1 and A2, the sarcomere is lengthened and at a mechanical disadvantage. FIG. 1, examples B1 and B2 shows the sarcomere when it is more contracted than in examples A1 and A2 with more mechanical or cross-bridge force advantage. Examples C1 and C2 shows even more contraction than in Examples B1, B2 with more cross-bridge force advantage. Finally, example D1, D2 shows yet more contraction than in examples C1, C2 and with even more cross-bridge force advantage. At example A1, A2 the distance between sarcomere Z-lines are greater and have more entropy, or energy potential to do work. At example D1, D2 the Z-lines are closest and have in theory maxed out their action work potential. What is unintuitive is that the distribution of effort for contraction is increased as the sliding filaments close over one another and have, since the point of after, between examples B and C, but before example D been redistributing the work load to the points of interaction where the troponin and sodium port channels (along the surfaces of the actin and myosin) are now distributing their workload, therefore decreasing the intensity of the effort needed before the end of the contraction for each point of interaction. Adding tangent chains throughout the movement to the Roberts Smart Chain increases the effort required to innervate the muscle and thus perform more work before the maximal entropy is normally achieved by the sarcomere's full contraction at example D. As the work is distributed to more action points (sodium port channels and troponin) during a contraction the effort is challenged with increased resistance from the Roberts Smart Chain and then more so with tangents as the points of interaction increase and share or distribute the work through a range of motion of muscle contraction (the exact function of actin and myosin filament's relation with a molecule outside the z-line called the titin molecule is still theoretical). The tangent chains increase the work required for contraction over the range of motion and thus over the range of points of interaction. This increased resistance naturally requires a greater recruitment of muscle fibers past the normal point of the inversely related point of distribution, as shown in FIG. 7 somewhere between example (a) and example (d) of work amongst the sarcomere's interaction points of the sodium port channels and their troponin lever counterpart, thus requiring a greater function of nerve innervation. The beginning point of an inverse reaction for most muscles supporting and opposing the prime mover, or the focused muscle, theoretically occurs near the mid contraction point where a Normal Tangent may be placed to increase the overall magnitude of intensity. Although all muscles should be properly engaged per exercise, they are none the less subject to rules of inverse and reciprocal alike and the further along an extension or contraction the more the tertiary muscles are engaged. Tangent chain 300 addition at this point increases the resistance, thus changing how the muscle would normally increase distribution or easing of workload among the points of interaction past the point of increased inverse reaction. All of this can be easily indexed with the time saving feature that utilizes the at least one data hub 210. The data hub 210 can be any one of a variety of apparatus that displays, holds, sends, transmits or conveys information, either through a visually identifiable mark and or by emitting, transmitting or conveying data, to a data processor. The data hub 210 could be a micro data unit, or micro data plaque. The data hub 210 also could include one or more sensors, such as an accelerometer, motion sensors, distance sensors, speed sensors, or any of a variety of sensors. The data processor can be a person or a machine, such as a computer. The data is then conveyed at the data communicator. The data communicator can be something as simple as a handwritten document that the user or someone else creates for the user while exercising, it could be data displayed on a computer screen or even data conveyed and displayed on a smart device, such as a smart phone screen or tablet device, as shown in FIG. 22.

The data hub 210 can be a Micro Data Unit that is a small piece of equipment meant to store, collect, hold, convey, compile, process, compute, emit, transmit, save, or exude data. It is a small piece or pieces of material used with the Roberts Smart Chain that is connected or placed in or on or attached to the Roberts Smart Chain or Tangent Chains, as shown in FIGS. 4A, 4B and 5A, 5B.

In its simplest form the data hub 210 is the Micro Data Unit 205 or Micro Data Plaque. In other words, it is a small plaque or placard that has, shows or hold information or data. It is called a Micro Data Plaque because it must be small enough to be secured at, on, to or within one of the chain lengths. This Micro Data Plaque can be as simple as a marker that indicates to the user the length and weight of the chain or the tangent at a location. The Micro Data Plaque can be nested or set in the Nested Data Cradle on the chain, the tangent chain or both. The data hub 210 can be used for a variety of operations and purposes. The equipment usability shall be, but is not limited to, a transmitter, a compiler, a processor, a recorder, an emitter, a data collector, a micro data plaque, a brail data plaque, an embossed micro data plaque, a basic languages and symbols micro data plaque, data pictures, data symbols, lettering, type, common symbols, complex refraction information technology, complex data holographic information or any imaginable marker used to convey information to the user.

One Micro Data Unit 205 is the Center Micro Data unit. The center Data Unit is made to have the options of information on the front or back. The back may be but not necessarily hollowed out for data units of a smaller variety to be placed in the Center Data Unit. One Micro Data Unit is the Long Micro Data unit. The Long Data Unit is made to have the options of information on the front or back. The back may be but not necessarily hollowed out for data units of a smaller variety to be placed in the Long Data Unit.

The Micro Data Unit 205 is generally used for two types of technology, with and without energy, or with or without electricity. The data that can be read, seen, reflected, or felt are generally placed on a Micro Data Unit 205 in the form of a Micro Data Plaque. This data may be printed, painted, etched, embossed, lasered, milled or any other form of inscription.

The other type of utilization of the Micro Data Unit 205 is with technology using power, such as, a transmitter, a compiler, a processor, a recorder, an emitter, a data collector or any other technological, relay, or transmission, or reception, or storage of information, more fully described below.

The purpose that the Micro Data Unit 205 serves is to provide convenient reliable information that can be used to record the properties of the exercise in respect to using the Roberts Smart Chain. This utilization is for, but not limited to, collecting information that can be interfaced with a smart device 235, such as a phone or a computer of some type such as a data interfaceable picture or text that can be read by augmented reality devices, a smart phone, or a computer, or such smart devices. But is also usable for displaying information that must be input by hand, such as a number, or text, or a code, or a complex information system like a hologram, or a refraction-based information technology. The Micro Data Plaque is also meant for customizable options.

Figure 3:
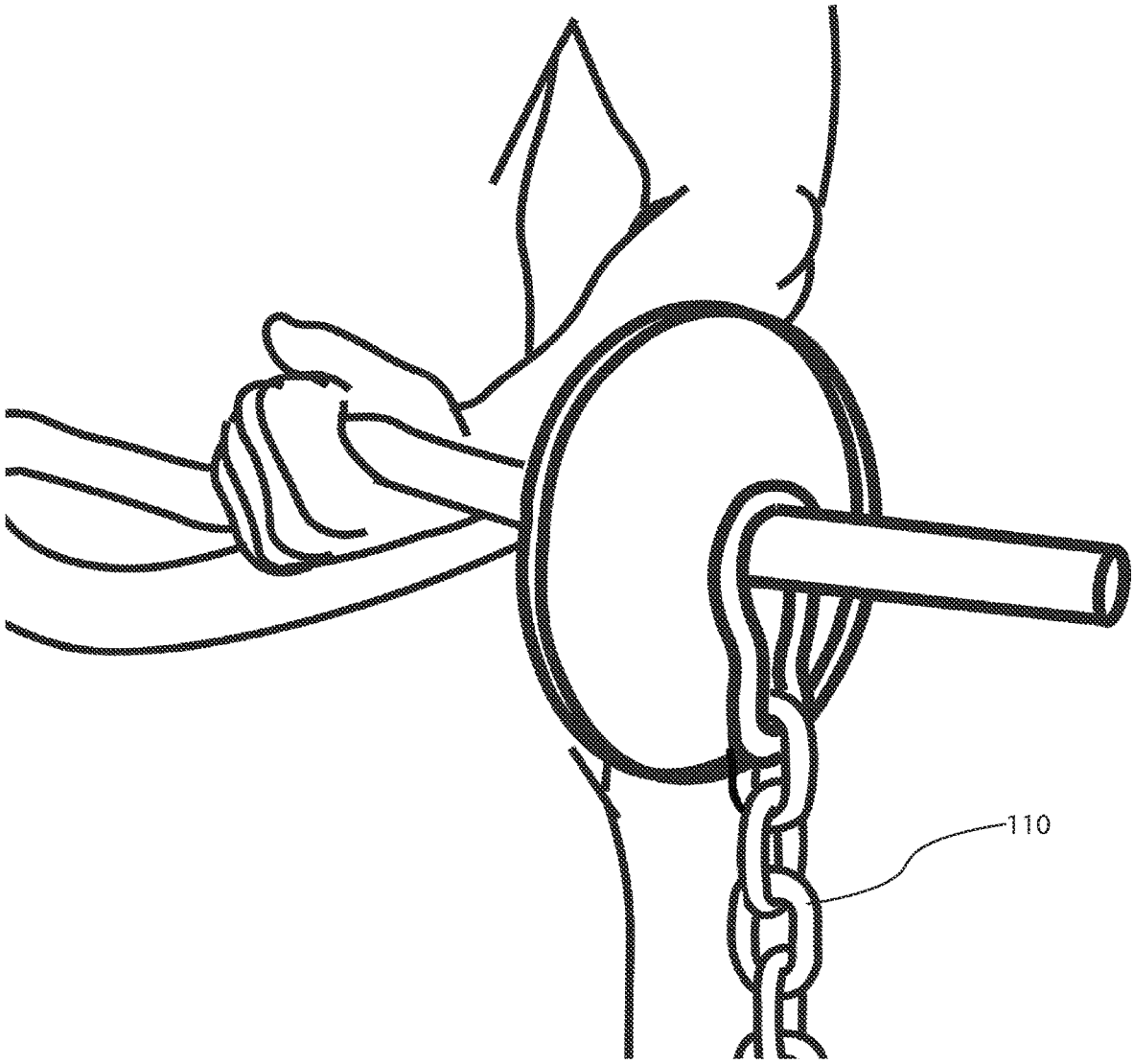
FIG. 3 is the Roberts Chain System as used during a bicep curl exercise.

FIG. 3 shows a user with a curl bar and the chain attached at one end. As is seen, the connection can be something as simple as a wider link that fits over the end of the curl bar. There could be a variety of ways and methods to attach the chain to the bar and the connection means is in no way limited by the disclosure herein.

The system of the present invention works to increase the user strength by providing resistance for muscle growth when applied to exercise or strength training. The Roberts Smart Chain 100 provides a hands-on measuring approach to what cannot be measured through intuition. The novel approach to recording or indexing the utilization of physical energy during muscle contraction allows for the simplifying of notation during difficult times due to such things as stress, time, visual distance, or low oxygen levels. The entire system can use the at least one or more Micro Data Unit 205, Micro Data Plaque, Data emitter, data hubs 210, the data processor 220 and the data communicator 230 to even more effectively index and record exercise sessions, as more fully described below.

Figure 13:
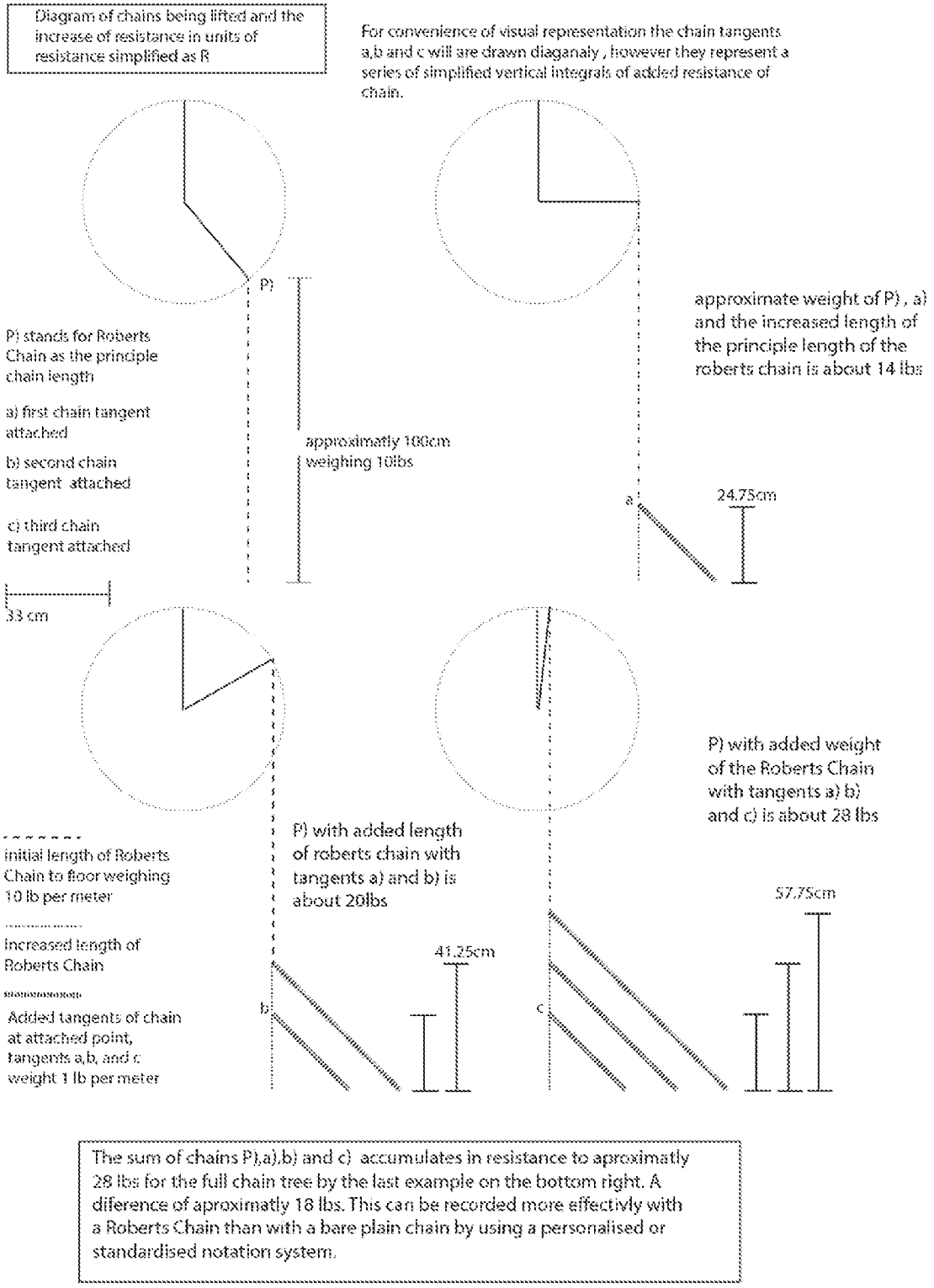
FIG. 13 is a diagram of how chain tangents accumulate resistance throughout a muscle contraction. This example uses the same circular symbols associated with the examples of the curl and chain set up that is explained throughout the specs to show the angle that of the contraction and its relation to the accumulation of tangents along with main chain to represent the total accumulated resistance in each given represented position or angle.
Figure 14:
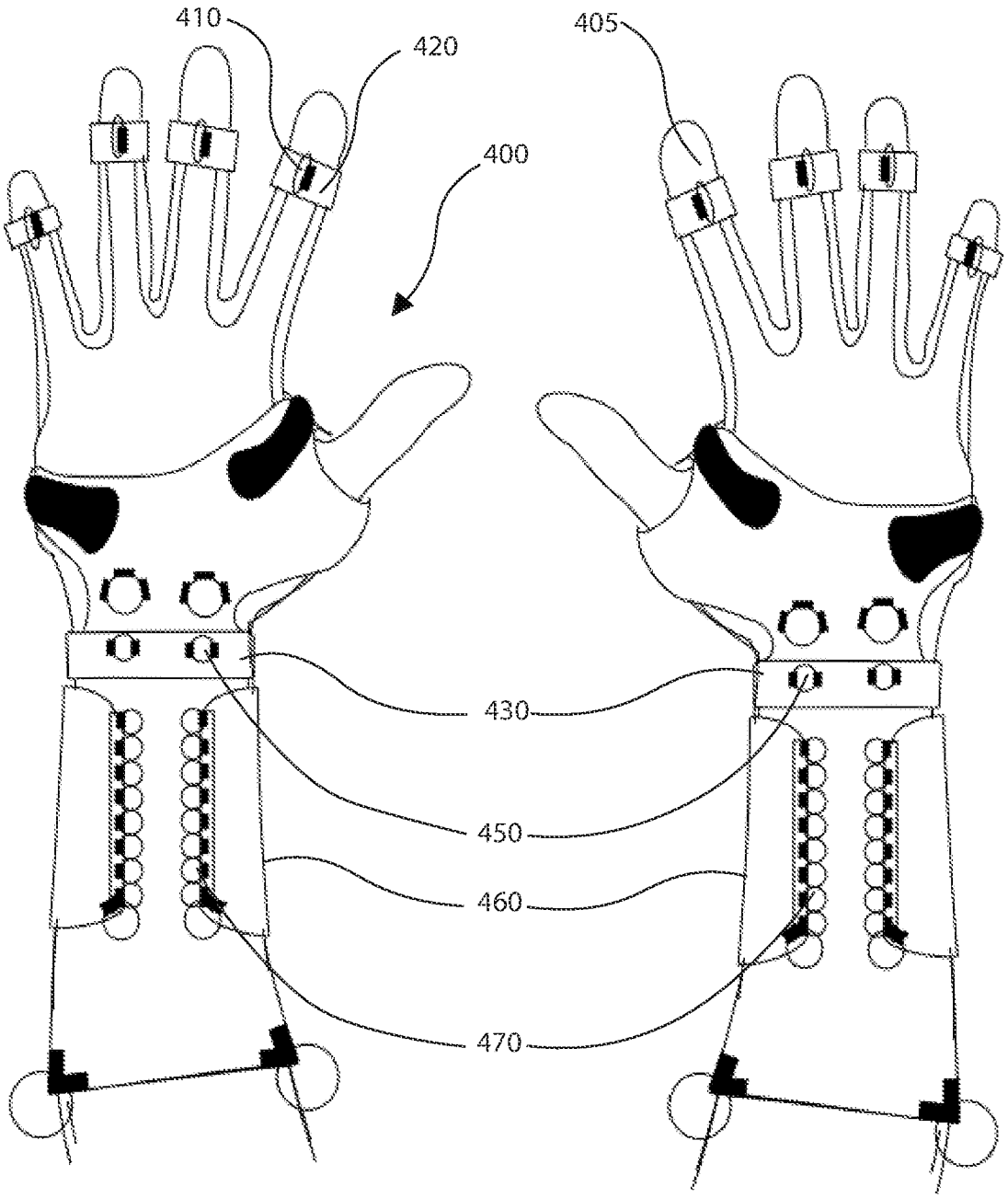
FIG. 14 is an example of the reversable Krugers with one finger connector ring per finger.

FIG. 6A shows an example of a football shaped graph approximating a muscle representing relatively the same range as the natural index discussed in FIG. 7 in the form of a curved football muscle grid centered over a grid of −10 through 10 on the x axis and from a range of −50 to 50 on the y axis. In the images at the top at example FIG. 6A the curve of the distal ends of the oval or football shaped muscle graph represents a simple example of the range of the sarcomeres extension which adds up in units to a total of 8 wide in of the example in FIG. 7. The muscle length on axis x represents the range of the 8 units in the full extension of figure FIG. 7, examples a, g, or m. If the physical circumference of a muscle, or rather this graph was to represent added information numerically (in consideration of the index of muscle action in FIG. 7) or interaction due to an increased resistance such as FIG. 9. then increasing the number of tangents would affect the distal ends of the football shaped graph, such as represented in FIG. 6C. This is represented by physical increase of indexing in the graphs in FIG. 6 (such as b versus c) as well as the difference of indexing of numbers in FIG. 7. and FIG. 9. Both the distal ends of the top graph in FIG. 6. would increase in magnitude of information due to increased progressive resistance presented with the main chain and attached tangents represented in FIG. 9 and FIG. 6(*c*) shows a natural disparity of interaction represented by the curved blocks over the muscle graph. Numbers clearly shows the example in FIG. 6(*c*) being larger at the distal ends. FIG. 6(*c*) shows how a chain would impact the accumulation of the interaction due to an increasing resistance customized to the explained relative disparity of the counting process or indexing of numbers shown in FIG. 9 and demonstrated in FIG. 13. in terms of weight of tangents of chains. The blocks in the graph FIG. 6(*c*) show the numbers accumulate faster than that of FIG. 6(*b*). For exercise purposes, but not limited to, the embodiment of the Roberts Smart Chain is used to increase resistance to aid in the relative efforts of an individual's resistance trainings goals of more strength by increasing the chain tangents over the range of a muscle or muscles contraction.

The index in FIG. 7 when counted result in a bell curve pair of interaction results represented or recorded as an index. In the cells in example FIG. 7(*a*). there is a limited range of numbers, 1 and 1 interaction points; however, by the end of the diorama in FIG. 7 in the last example FIG. 7(*m*) the discrepancy increased to a range of 2 points of action to 13, a sharp increase in range. The diagram shows the net difference and does not suggest personal goals of weight increase or weight loss.

FIGS. 7(*a*) through 7(*e*) are a recording of interaction representing an index of action of a sarcomeres contraction written down as 'times the actin filaments action units moved across and back a functional unit of the myosin' recorded in each of the graph's cells as an increase by a 'one per action unit' interaction per cell. In the examples, (a) through (m) are the length of the sarcomere at a specific point of contraction. Beginning with an amortization period representing when the units make no movement during a reassessing by the nervous system to perform action (muscle innervation and action commonly theorized as to be more complex than the current understanding of modern physics about mass, time-space and causation of action or motion; this diagram makes no claim as to nature of cause of action or cause of recovery). In FIG. 7 (as well as FIG. 8 and FIG. 9) the empty circles represent actin while the circles with lines through them represent myosin.

As the diagrams in FIG. 7 progresses, one can notice the numbers away from the center of each indexed cell of information. The numbers of interaction increase in the center of each opposing side at a greater rate than the numbers in the center or sides of each cell. This happens because they fundamentally receive less action on the sides and center and this difference builds up over time to a noticeable disparity represented as the dioramas bell curves shown accumulating inversely as a hypergeometric grid in FIG. 6(*b*) and FIG. 6(*c*). FIG. 6(*a*) represents the index of usage each sarcomere endures through a cell's time frame, in the form of a football graph ranging 8 units on both sides of zero on the x axis, and ranging approximately 13 high on the y axis just like the range in FIG. 7. This will be the range of the indexing of interaction when force or action occurs. This is a property associated with Newtonian force and requires recovery due to such energy demands. What is known about action in muscles is that they compete with the body for nutrients/energy during action and for recovery. This dichotomy is an example of the information and resistance a Roberts Smart Chain is intended to be used to identify through measure of resistance, length of increased or decreased resistance, and the recording of the recovery. The diagram of the different indexed interactions shows the numerical buildup of difference.

FIG. 6(*c*) is a diagram of how the distal ends of a muscle can be shown as having increased in size in reference to the information about the curve of the graph increasing its derivatives of information due to tangents at the distal ends of the curve of the graph represented as volume of muscle applied inversely as mass. Simply put, a person's muscle graph of interaction is larger if a Roberts smart chain with tangent chains are added and used. In real life if a chain tree is used, and the muscles are properly recovered under current metabolic theories of healthy resistance training the result will be increased strength. The graph in FIG. 6(*c*) is an intuitive example of what the muscle index graph would look like, such as in FIG. 9, if more tangents had been added and the numbers of interaction, (not actual muscle in this example) were increased. This is an example of how muscle action's history of interaction on the cellular level in the form of work performed and therefore recovery has an irregular nonlinear accumulation of actions due to the mechanics of a sarcomere in the theoretical model. This theoretical model is one of, but not the only, basic rational for the need of a more accurate time sensitive durable measuring resistance device.

FIG. 6(*a*) shows a football shaped muscle graph as a basic reference of the shape of the index accumulation, while FIG. 6(*b*) shows how those same numbers make for a series of blocked out areas that represent an index accumulation seen throughout FIG. 7. This allows the reader to compare the numbers or accumulated index of interaction in FIG. 7. seen in FIG. 7(*m*) the Natural Index with two repetitions to the accumulation of index and interaction points seen in FIG. 9(*m*) also with two reps but instead with a chain tree increasing with an advantage of +1, +1, +2, +3, +4.

The blocks in FIG. 6(*b*) and FIG. 6(*c*) begin in their relative column, where the actin ranges from an interaction in FIG. 7. (a) through FIG. 7. (m) over 5 interaction points of cross bridging. Using this limit the rounded blocks will be expressed and counted up to as a summation. The rounded blocks will start approximately as 2 in the far left and far right in FIG. 6.*b* and range to 13 in the center ranges. In FIG. 6(*c*) representing figure FIG. 9 it will range from 10 to 26. FIG. 6(*c*) shows the remarkable difference when adding increased resistance of a chain tree and the natural index together, far greater than that of FIG. 6(*b*) that represents the basic contraction of a muscle just as many times. With an added weight the natural index will still accumulate the same and in fact with enough weight the exercise will not be possible. The range of where the muscle cannot contract due to an increased single point of chain and at what range can be further investigated with an inverse approach loading more chain trees instead of more weight. Although this method may be complex it is not possible with just a single consistent weight to explore smaller increments of weight over a range such as it is with a marked measuring chain such as the Roberts Smart Chain.

In FIG. 9 it can be seen the natural index premise as an accumulation in row zero) but this is added to the increase of the +1,+1,+2,+3,+4 accumulation and in each and every example that sum is added along with the previous summation. The total summation in FIG. 9(*m*) of 10 to 26 is far greater than that of the summation of 2 to 13 in FIG. 7(*m*).

Figure 8A:
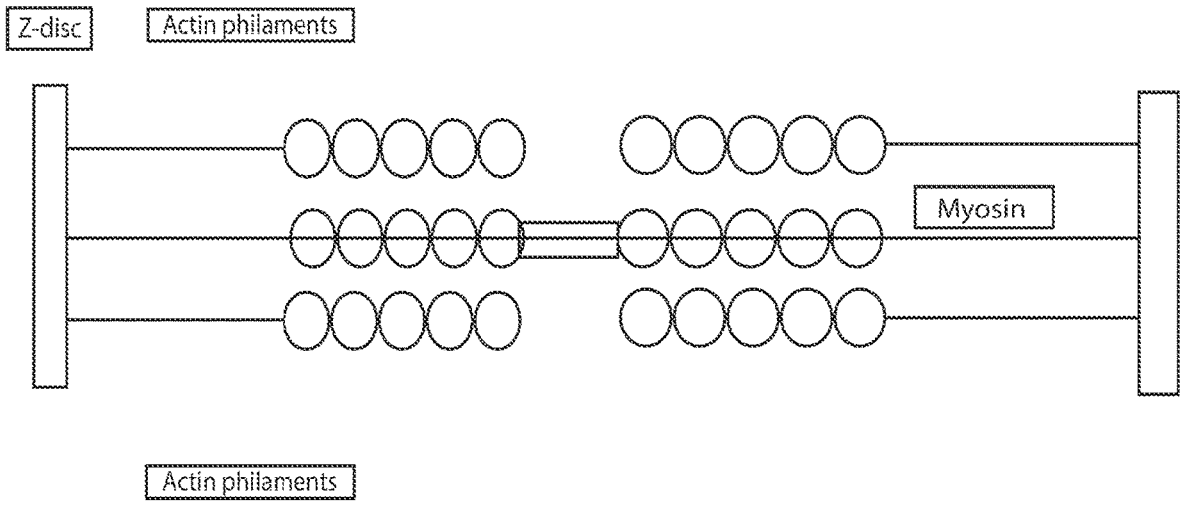
FIG. 8A shows the basic cellular parts of the sarcomere involved in the discussed accumulated points of interaction that have been displayed in FIGS. 6A, 6B, and 6C.
Figure 8B:
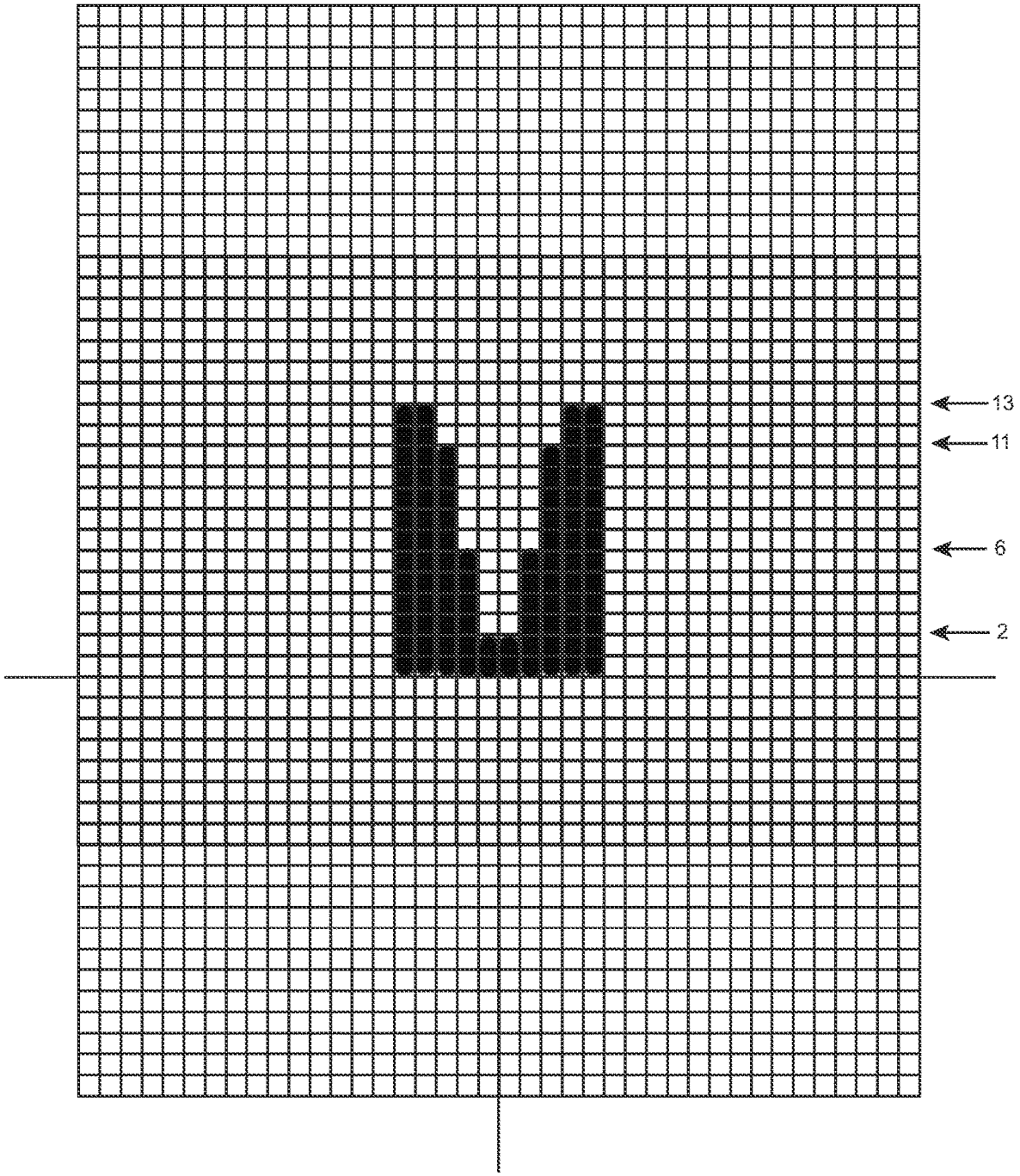
FIG. 8B is a chart showing an example of the range FIG. 6B accumulates in two muscle contractions generating an index of 2 to 13 shown as blocked out columns.
Figure 8C:
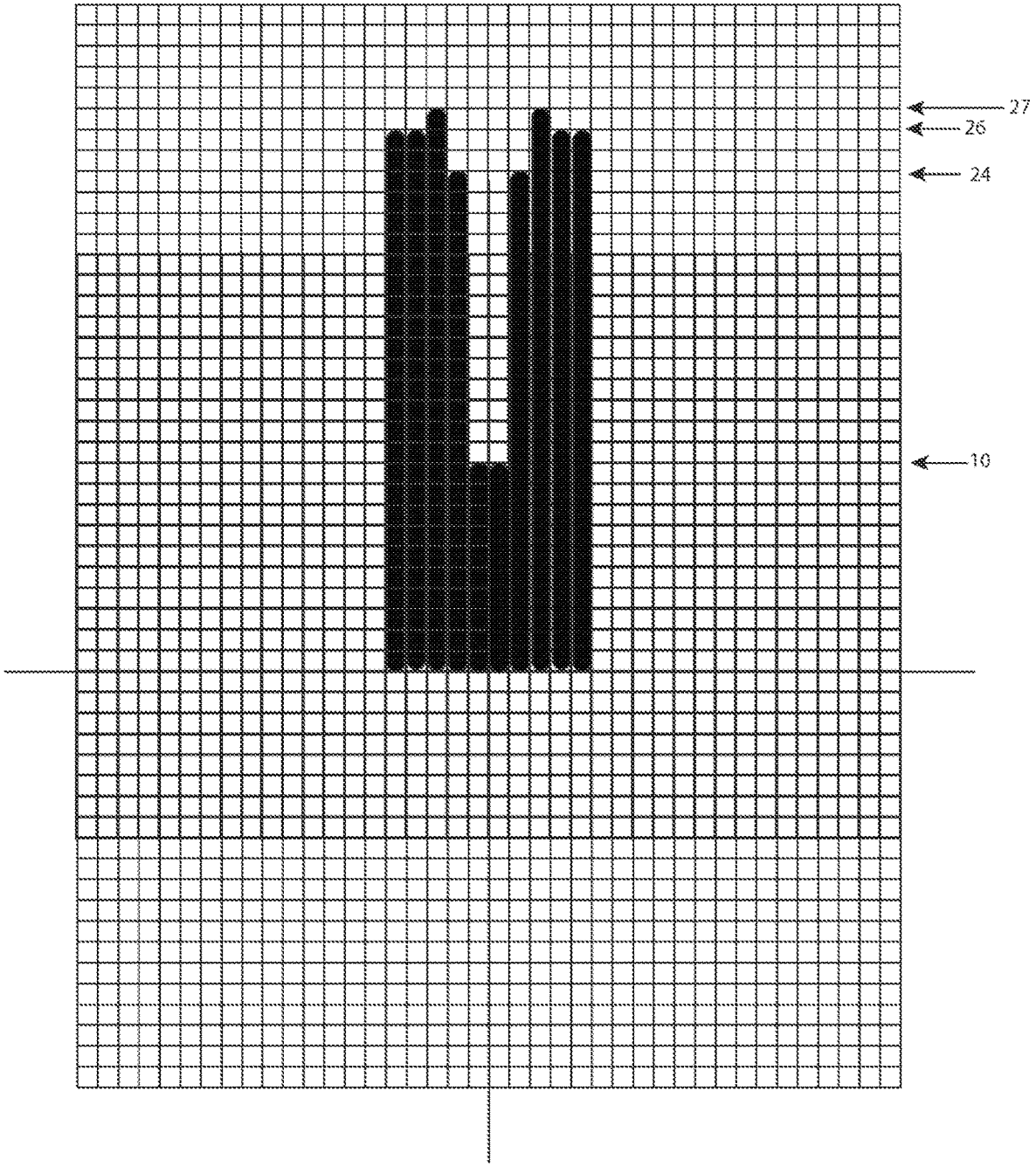
FIG. 8C is a chart showing an example of the range FIG. 6*c* accumulates in two muscle contractions using the Roberts Smart Chain system generating an index of 10 to 26 shown as blocked out columns.
Figure 9A:
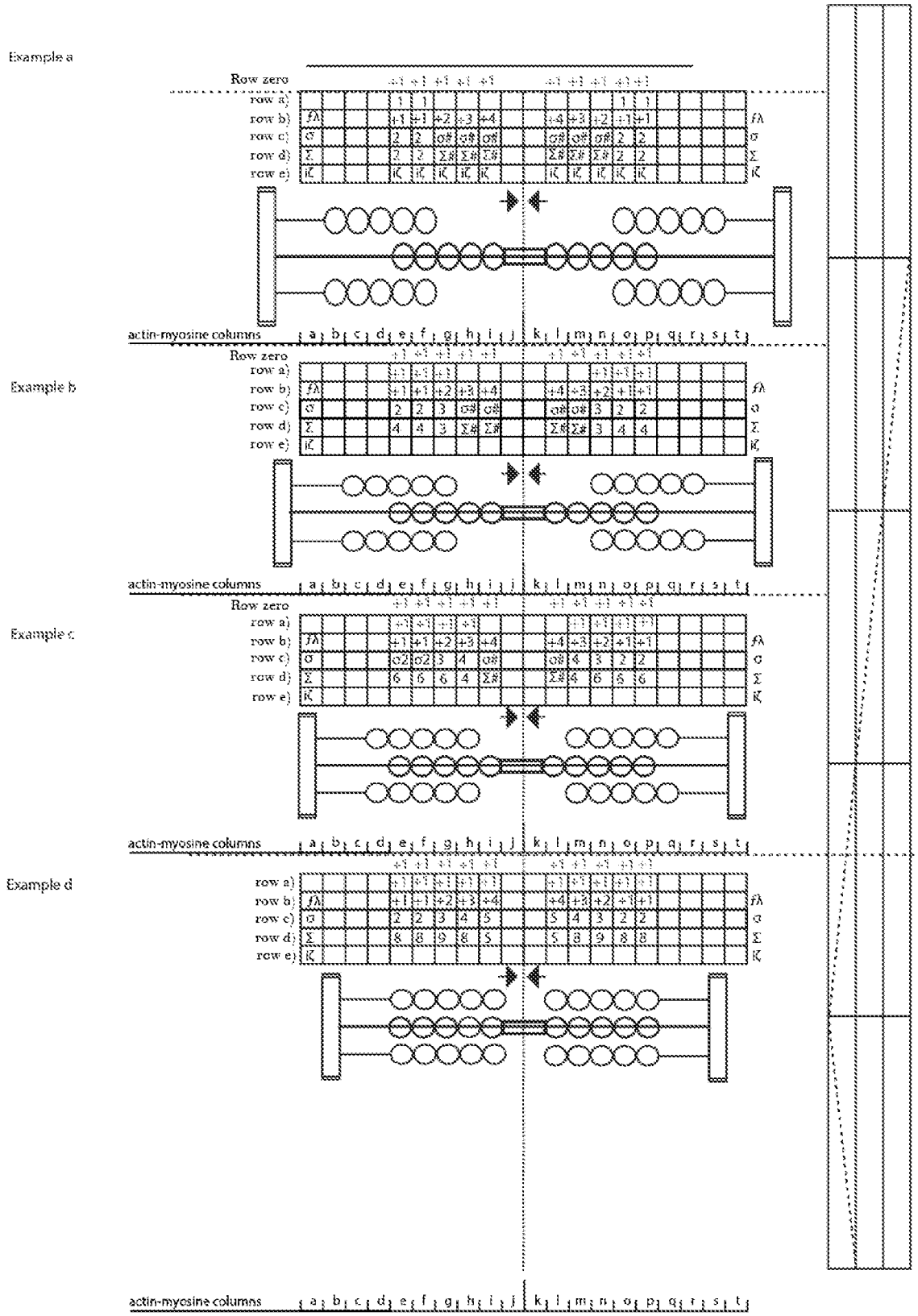
FIG. 9A, FIG. 9B, FIG. 9C, FIG. 9D are detailed diagrams of two Sarcomere contractions of the accumulated interaction points described in FIG. 8C.
Figure 9B:
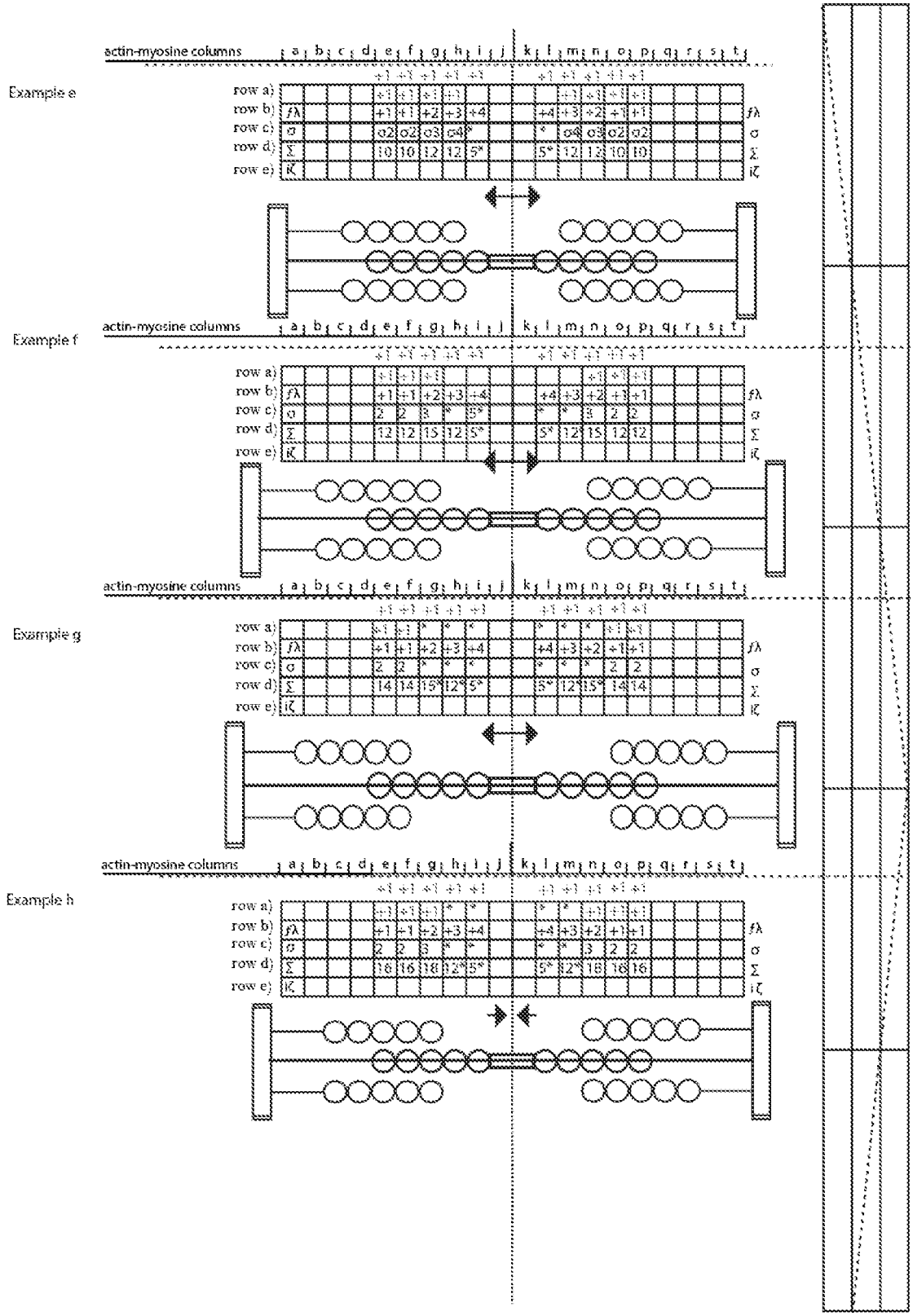
Figure 9C:
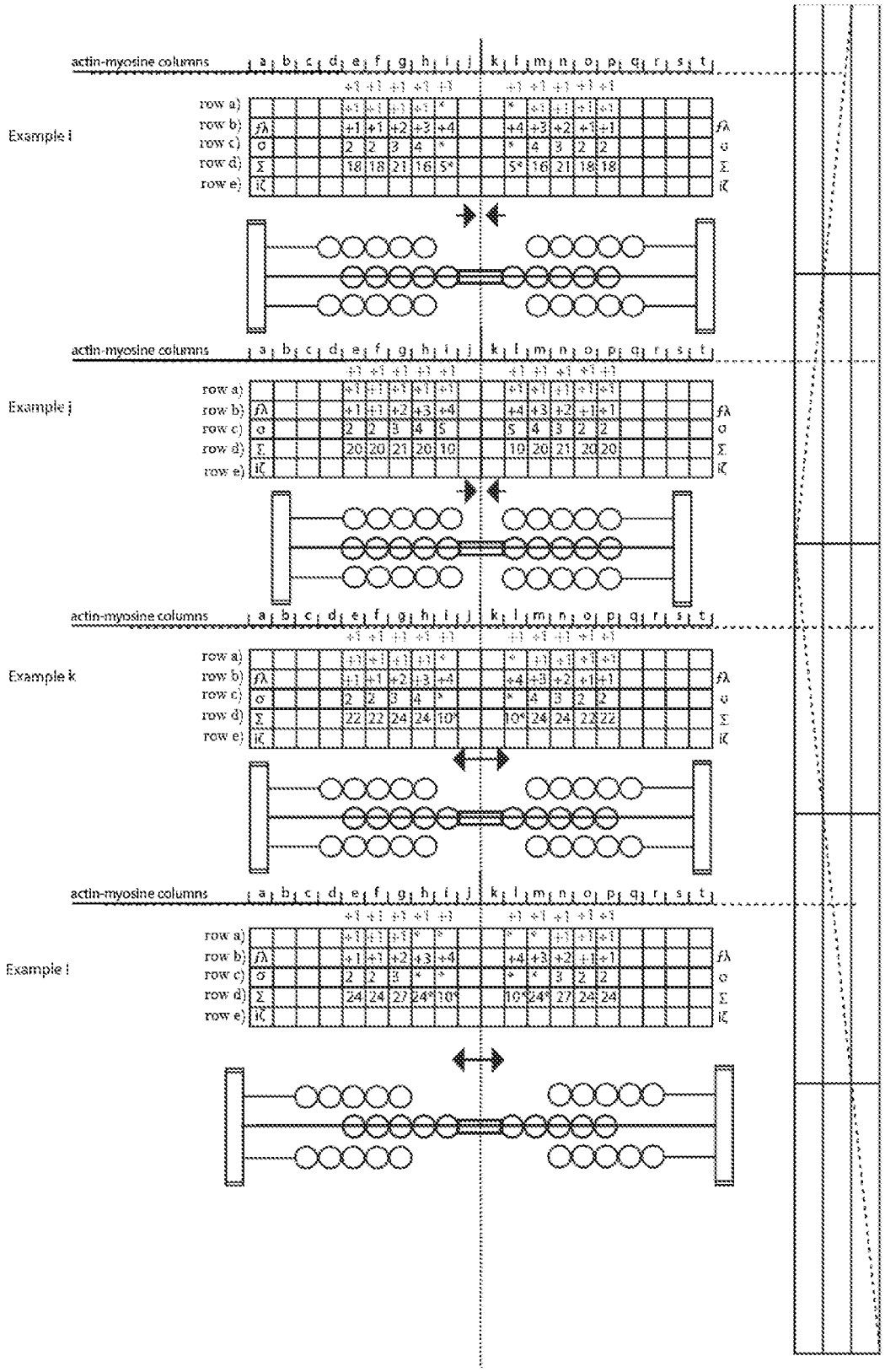
Figure 9D:
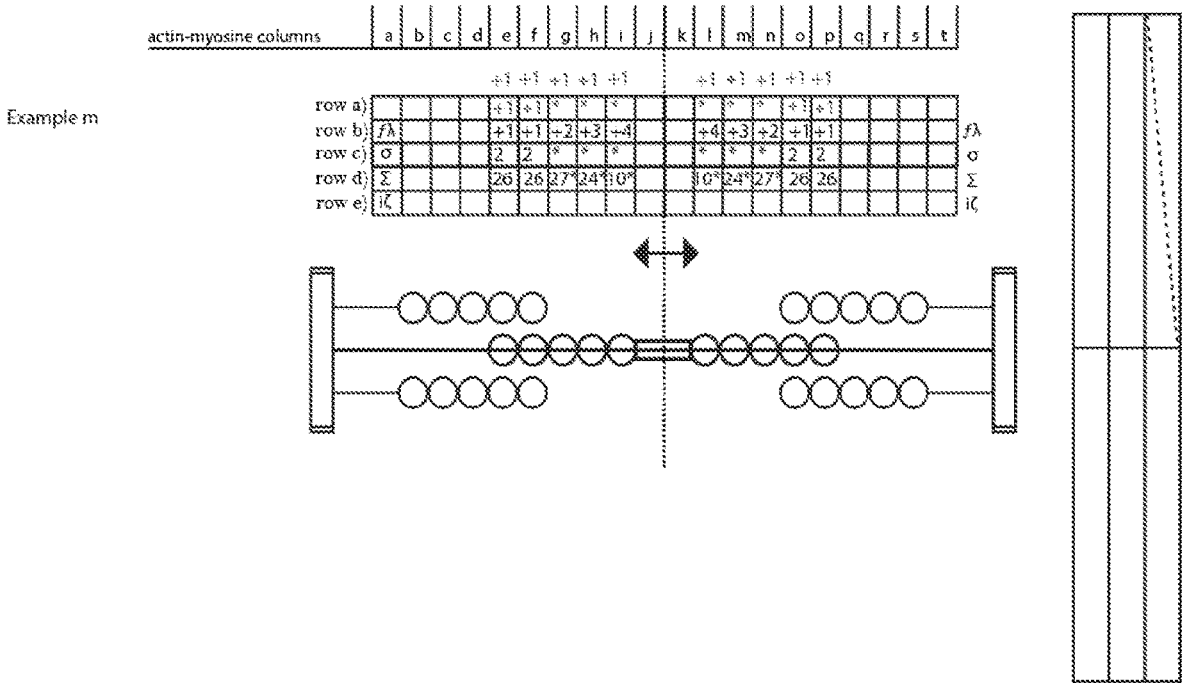

FIG. 8 images are similar to FIG. 1 (example A1) but in this Figure the sarcomere is shown along with an image of the user and user's arm placement (represented by partial circles and line symbols during a workout). FIG. 1 (example A1) shows a fully lengthened sarcomere at mechanical disadvantage. FIG. 1 (example A2) the user, shows a corresponding bicep curl and the length tension relationship to the lengthened sarcomere. FIG. 1, (example B1) shows the user and discloses a more contracted (cross bridged) image than is shown in FIG. 1 (example A1) and with more mechanical advantage. FIG. 1 (example B2) is the corresponding bicep curl and the length tension relationship. Next, at FIG. 1 (example C1) this image shows an even more contracted image compared to FIG. 1 (example B2) and with still more mechanical advantage than in the previous image. FIG. 1 (example C2) shows the user and the corresponding bicep curl and length tension relationship. Finally, at FIG. 1 (example D1) there is an even further contracted sarcomere than in the previous image and even more mechanical advantage. Finally, the user is shown in FIG. 1 (example D2) and the corresponding bicep curl and length tension relationship fully cross bridged and or contracted similar to FIG. 8A.

The preceding description explains what happens while actually using the Roberts Smart Chain. The Chain itself is described next. In a preferred embodiment, the Roberts Smart Chain 100 weight training apparatus has the at least one data hub 210 described above and the data hub 210 is located at the at least one connection marker 150. Preferably there is more than one connection marker 150 and there is more than one data hub 210, and each data hub 210 is located at each of the connection markers 150. These data hubs 210, can be extremely simple, non-digital data conveyors, such as the Micro Data Unit, or Micro Plaque described above that contains written information. They can be color or shape coded, a simple data sticker, they could be a readable QR code, or any other type of data communicator that conveys information to the user, such as where the tangent is attached to the main chain. On the other hand, they can be simple digital devices or complex digital devices. In more elaborate, electronic versions they are data coded with preloaded data that provides a variety of information. This information could include the data hub's location along the main chain and the chain's weight at a specific location. It could also include other preloaded data such as specific user identifying information, previously stored or uploaded training information, training goals, specific weight or repetition goals, or any other information to assist the user with lifting, and more generally, training and health. In addition to this preloaded data in another embodiment the data hub actively collects data when the user is lifting and they could have a variety of sensors incorporated into the device, such as accelerometers, speed sensors, distance sensors, or any other sensor that can collect and convey information and data. This data could include the chain's weight and other specific information such as the time of day, location, such as at the gym or at the user's home, duration of the workout, number of repetitions performed, number of additional tangents added during the lift, and any other useable information. Ideally the data hub can also be a data emitter that can communicate with each other so that data communicated to the data processor is accurate, precise, and comprehensive. For example, if two tangents are added then the two data hubs communicate to convey to the processor that in fact two tangents rather than just one tangent was added to the system. In another embodiment the data hubs 210 are a part of the main chain 110 rather than a part of the tangent chains 300. In this configuration the intelligent part of the system resides in the one or two main chains 110 rather than being a part of the tangent chains 300. Alternatively, it is also possible to have the data hubs 210 reside within the tangent chains. This can also be beneficial because it is envisioned that these chains can be of different weight and/or different length and each data hub 210 can then individually identify the tangent chain 300. In a final embodiment it is possible to have part of the data hub 210 reside in the main chain 110 and part of the data hub 210 reside in the tangent chain 300. In this embodiment the system would effectively include two separate data hubs 210 that would communicate and work together during tangent chain attachment. In this configuration the parts could talk to each other and would know what type of tangent is being attached, where it is being attached, and all the information previously stored, along with the new information acquired during the lift. This information is then communicated to the data processor 220 prior to communication to the user via the data communicator 230.

Figure 4A:
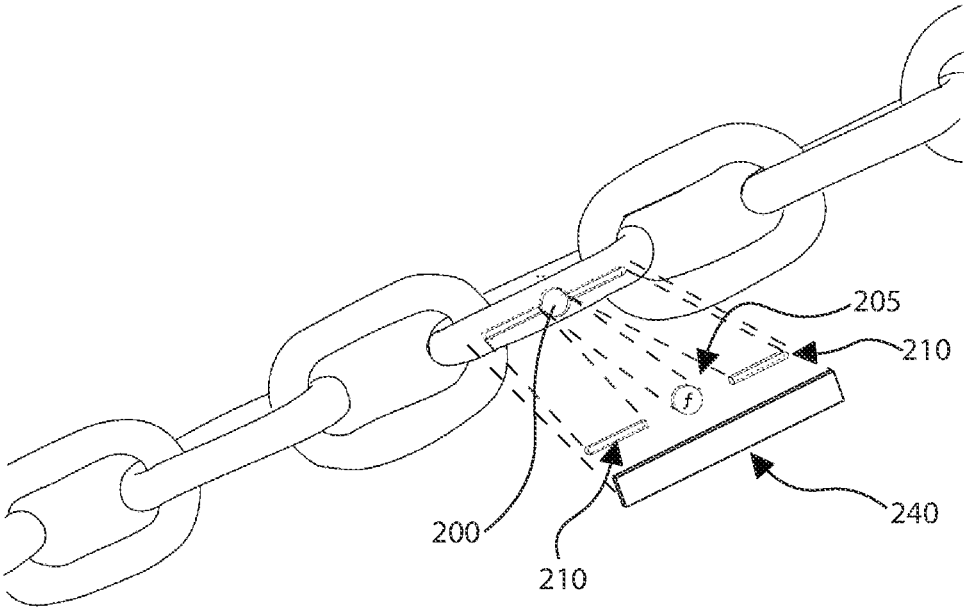
FIG. 4A shows the chain links with a micro data unit and a nestable data cradle.
Figure 4B:
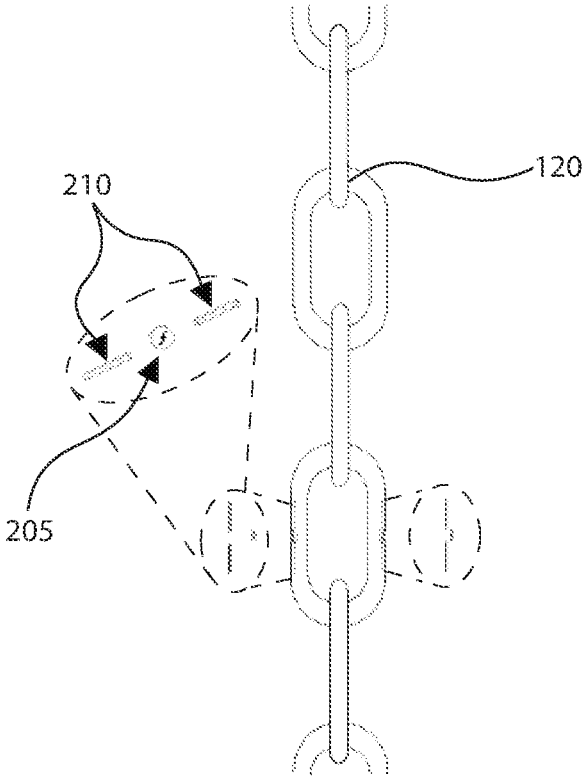
FIG. 4B shows the chain links with a micro data unit and a nestable data cradle.
Figure 5A:
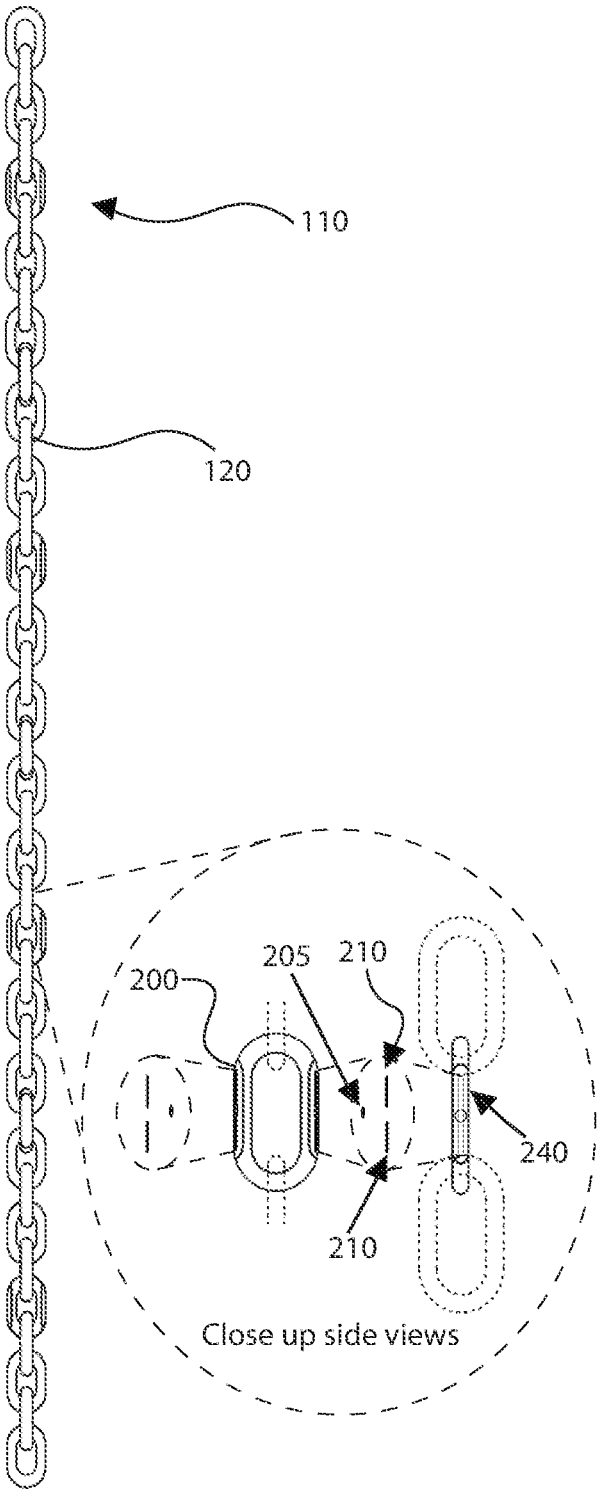
FIG. 5A is another view of the Roberts Smart Chain. Here it is shown without attached tangents.
Figure 5B:
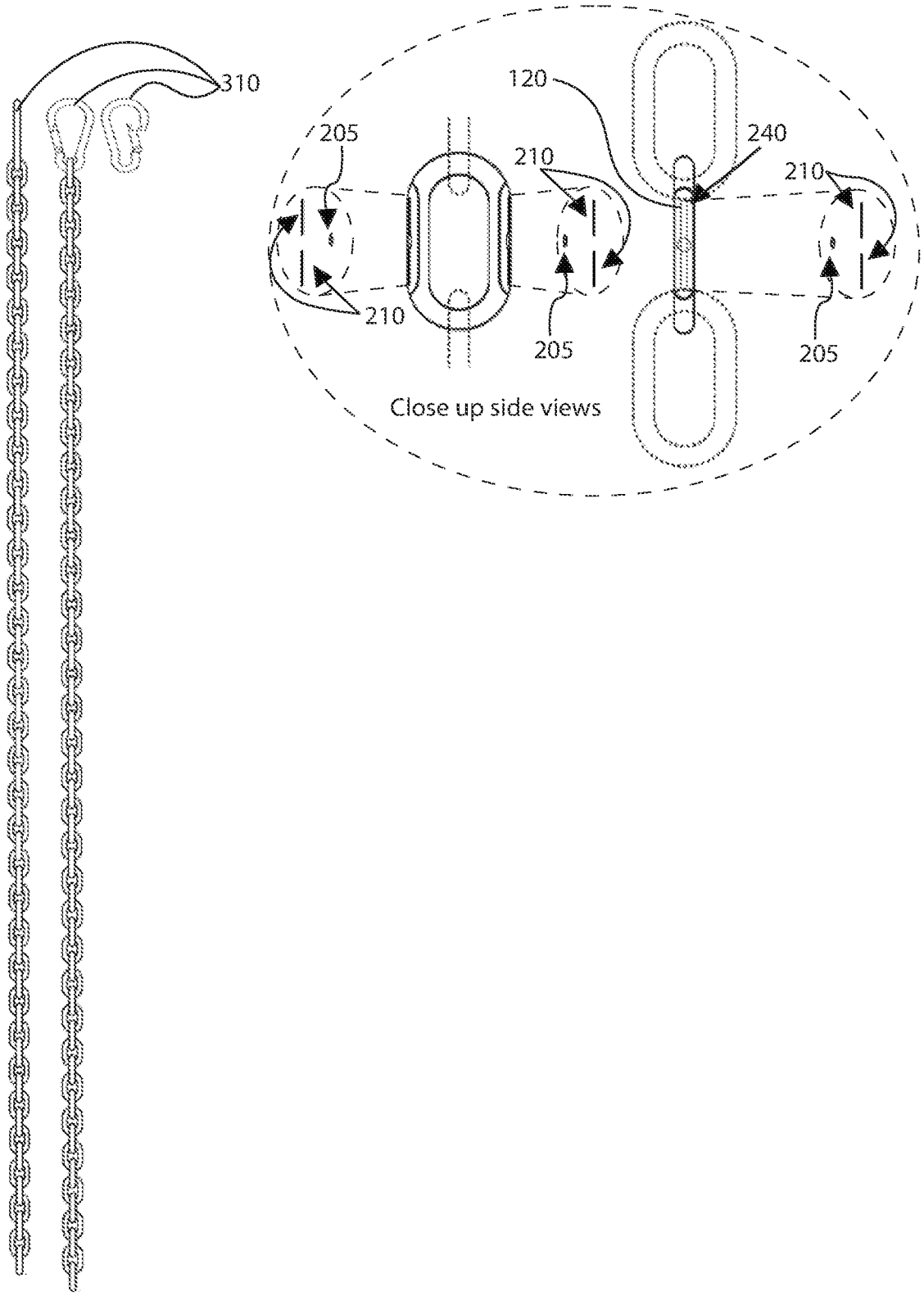
FIG. 5B is the Roberts Chain with a tangent chain connector shown at the first link of the chain.

This data hub can, as described above, be very simple. It can be the Micro Data Plaque that is a simple identifier that lets the user know specific information. This information can be written on the plaque, it could be in braille, it could be color coded, it could be shape coded, or it could be any other configuration that easily conveys information to the user. There are wide variety of ways to connect, attach, or build these data hubs into the system. One way to do this is to have a nested data cradle 200, as shown in FIGS. 2, 4A, 5A. In this embodiment there is a nestable data cradle 200 for securing the data hub 210 within the nested data cradle 200. This nested cradle is a recessed cradle area within the chain link so as to house, hold and secure the data hub 210. These data hubs 210 can be any shape but in this embodiment they are oval shaped so as to matingly fit into an oblong or oblong recessed, nested data cradle 200 placed within the center of the outside surface of the links along the Roberts Smart Chain 100. In other words, a cradle or recess is hollowed out of part of the chain link to provide a storage space within the link itself. The data hub 210 is then securely affixed within the storage space. Ideally a protective surface member 240 or coating is added on top to cover and protect the data hub 210 underneath. This protective surface 240 can be glue, silicon, adhesive, or any other material that will secure the data hub 210 within the cradle 200.

Recording written lifting data is time consuming at best and extremely inaccurate at worst. Thus, there is a need to have a way to automatically capture, record, store and compare exercise data. Currently several smart devices can measure walking distance, speed, running distance and speed, hiking distance, elevational gain or loss, heart rate, pulse, oxygen levels, can notify users of a fall, can take ecg's and the applications are continually growing. However, there does not currently exist a way to measure weightlifting using the current system. The ability to have the Roberts Smart Chain user's digital information conveyed or compared or transferred is simplified by using information through, but not limited to, symbols and now through digital and electronic technologies.

In operation, these electronic data hubs 210 take the previously stored data, combine it with any newly acquired data, and send the compiled data to the data processor 220. This data processor 220 can be located within the same nesting cradle 200, it could be at a computer designed specifically for the lifting system and located at or on the chains themselves or at a computer near the chains, it could be the user's personal computer or laptop, or, in a preferred embodiment, this processor is a smart device 235, such as a smart phone or tablet, as shown in FIG. 22. In this smart device 235 embodiment there is an application that is downloaded to the user's smart device 235. Then the smart device 235 acts as the data processor. The app cooperates and works in communication with the smart device 235 to compile the collected data and to output user friendly data. This data could include weight lifted, added weight lifted, number of repetitions per work out, number of repetitions total, gains or losses in muscle mass or strength based on accumulated information, and a wide variety of other information that could be collected and presented to the user. Ideally this new information is compiled with other health data already present on the smart phone and then continually updated with new data from all health applications on the device. Smart device 235 devices have already achieved some success in this area and as technology advances these systems will only get better.

In another embodiment of the present invention there is a weight training apparatus, having at least one main chain 100 having a series of interconnected segments 120, at least one connection marker 150 at specified segments 120 on the at least one main chain 110, at least one tangent chain 300, at least one tangent chain connector 310 to connect the at least one tangent chain 300 to the at least one main chain 110, at least one glove 400, and where the at least one glove 400 is connectable to and operational with the at least one main chain 110. As in the first embodiment, when in use there are multiple, different exercises that can utilize the chain. However, this embodiment is designed to be used with a glove 400, called a Reversible Kruger strength training glove. The user can use one or two gloves, depending on the exercise performed.

FIGS. 10-12 and 14-21 are illustrations of the Kruger strength training gloves having four fingers and a thumb member. The Kruger glove 400 is a training glove that has connector connecting members 420, such as rings, at each finger that are used as attachment points for the Roberts Smart Chains 100. The Kruger glove 400, available with the rings on one side or both sides, are designed to work compatibly with the Roberts Smart Chain 100. When the rings are incorporated on both sides of the glove they are called a Reversible Kruger. The glove 400 can be made from cowhide or synthetic material but it is envisioned that the glove 400 could also be made from steel or metal so as to withstand the rigors of a lifting workout and extended exercise and use without compromise. They could be made from steel mesh, or in the alternative, have metal connection points fabricated into the glove 400 so that the glove 400 can attach to the Roberts Smart Chain 100.

In a preferred embodiment the glove 400 has at least one finger 405, at least one finger connector 410 attached to and extending from a top of the at least one finger 405, at least one finger connector connecting member 420, where the at least one finger connector connecting member 420 is connectable to the at least one finger connector 410 and to the at least one main chain 110. In use the glove 400 has four fingers and a thumb, but could have fewer fingers and may not even have the thumb. In this embodiment, shown in FIGS. 10-12 and 14-21 it can be seen that the Reversible Kruger glove 400 is designed to position and configure a user's hand so that the user can properly orient the hand to properly and best utilize the Roberts Smart Chain 100. In other words, it seamlessly aligns the user's hand muscles for proper usage of the Roberts Smart Chain utilizing a chain counting method of indexing the lifting resistance through Roberts Notation. The glove 400 features a series of connectors that are attached to a back, or dorsal side of the glove for resistance exercises meant for the forearms, hands, and extensor muscles or worn relatively reverse for the forearm and fingers flexor muscles. These connectors 410 can be rings, snaps, clips, or any other type of connector that can secure the finger to the chain. FIG. 11 shows a backside of the Kruger Glove 400 and here the system is shown with rings and in the images they are more clearly visible. In this embodiment there is at least one ring per finger for Roberts Smart Chain attachments.

Figure 10:
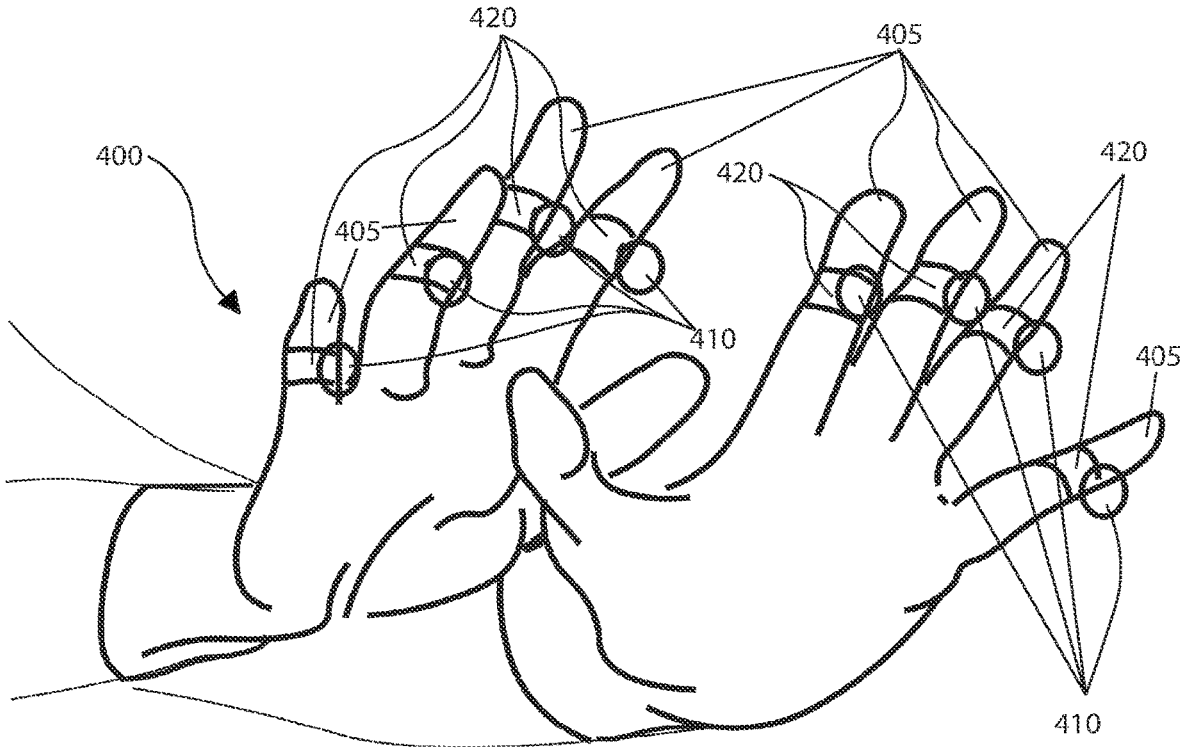
FIG. 10 is a generalized application of a reverse Kruger application. A reverse Kruger exercise is the application of the reversable Kruger for the use of strengthening the extensor digitorum on the dorsal side of the forearm.
Figure 11:
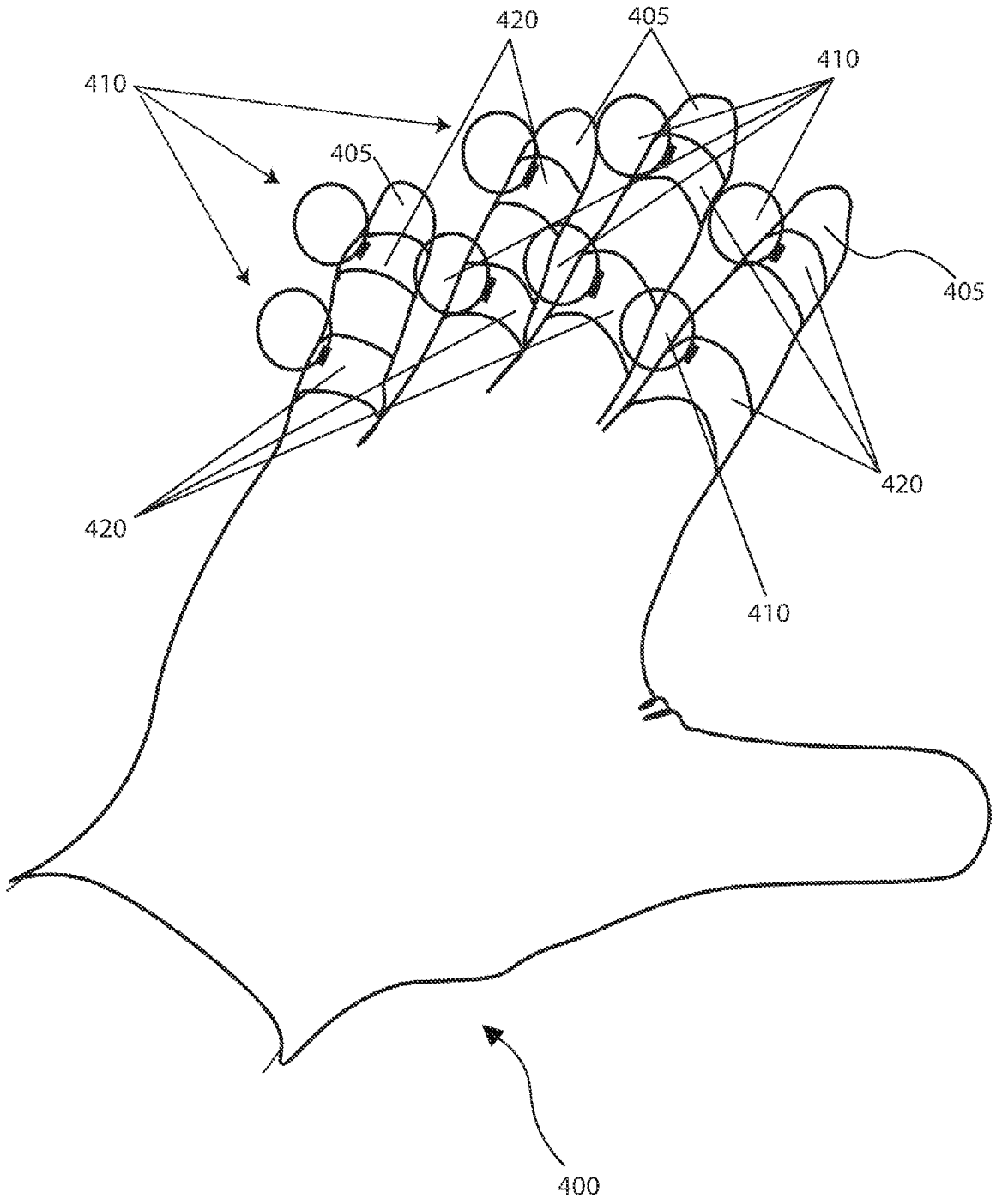
FIG. 11 is a generalized figure of a Kruger glove with two rings per finger on the posterior position of the gloves.
Figure 12:
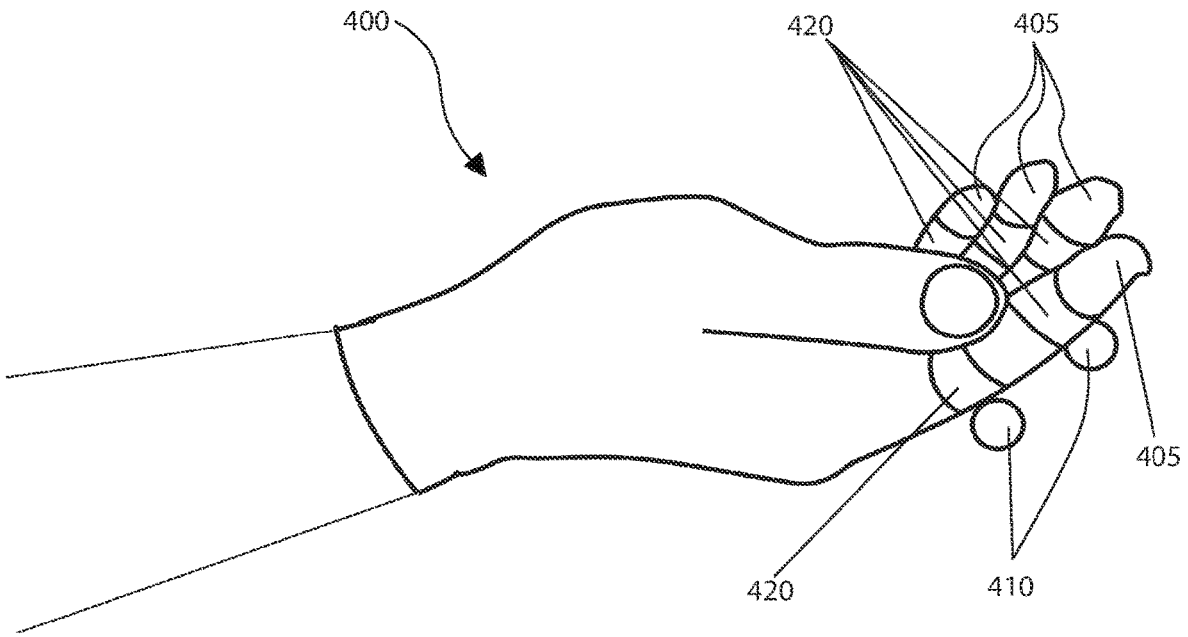
FIG. 12 is a figure of the Kruger glove with double rings.

FIG. 10 is yet another view of the Reversible Kruger and Kruger 400 in the form of the Reverse Krugers gloves 400 with rings shown attached to and extending from the palm side of the hand. In this Figure there is only one ring per finger, but it should be noted that the invention is not limited to one ring only. There can be multiple rings per finger, and they may be attached to either the rear or the front of the extensor resistance glove or flexor glove. When the rings are affixed to the dorsal section of a glove the item is called a Kruger; when affixed to the front or palm side of the glove the item is called a Reverse Kruger. Extensor digitorums, (extensor glove, Reverse Krugers) are the muscles that extend the fingers and raise (extension) the wrist dorsally. Flexor digitorums are the anterior flexion muscles for the fingers, hand and forearm complex (regular Krugers).

The Krugers 400 are used to attach the Roberts Smart Chain 100 for the purpose of progressing resistance for muscle contractions of the deep forearm muscles. The Roberts Smart Chain 100 is used to progress the accumulated resistance as has been described so far in this application as both an accumulated index of an interaction and also as a resistance of weight by attaching additional tangent chains 300. Attaching the Roberts Smart Chain to each Ring via the loops on the fingers of both the single and Double Ring Reversible Krugers or the Single and double Ring Reversible Krugers creates a way to utilize the progressive resistance. The muscles on the back of the forearm, such as the extensor digtorum, is a difficult muscle to exercise, as are the deep muscles on the front of the forearm. Other than normal linear approaches to resistance training, no equipment on the market allows for the increase of resistance optimized by the Roberts Smart Chain. The Roberts Smart Chain creates a system designed to provide increased resistance progression using the main chain, or measuring chain, the tangent chains and the gloves.

The Reversible Krugers have durable, firm finger connector sleeves with reinforced attached finger connector connecting members 410 at each finger (not including the thumb) so chains may be attached using the finger connector 410 and the connector connecting member 420, thus connecting the finger to the chain. The connecting members can be similar to the connecting members used to connect the tangent chains 300 to the main chain 110, as described above. It could be a carabiner, a spring clip, or any other apparatus that easily and securely connects the main chain 110 or tangent chain 300 to the finger connector 410. The connection could also be performed using a snapping member, a clip, a locking belt type member, or any other type of connector imaginable. The finger connector 410 and all materials generally are made with durable materials that can withstand heavy duty resistance. The Reversible Kruger Gloves are both reversible and can be worn ambidextrously.

Figure 15:
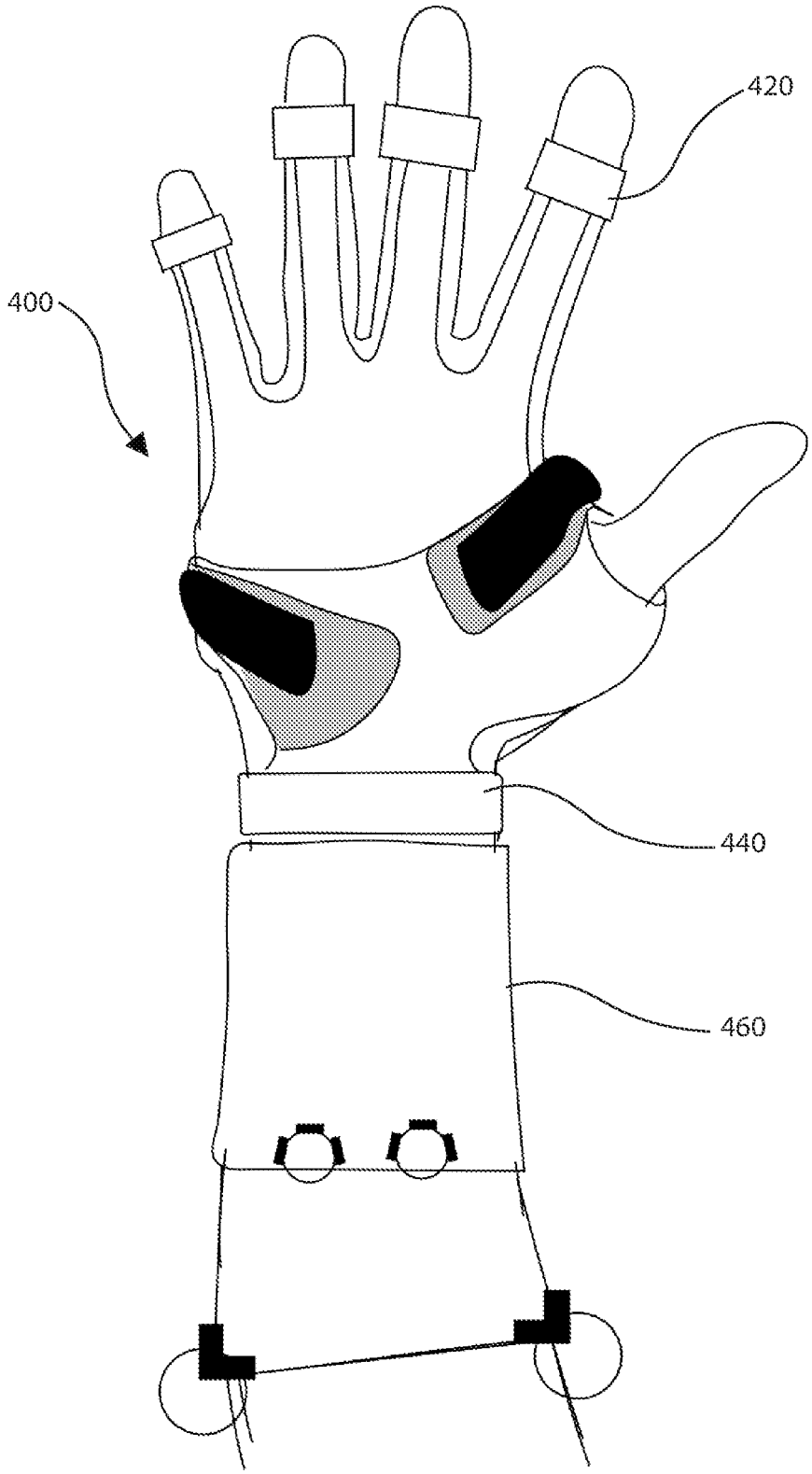
FIG. 15 is an example of the opposite side of the Reversable Krugers with one ring per finger, as shown in FIG. 14.
Figure 16:
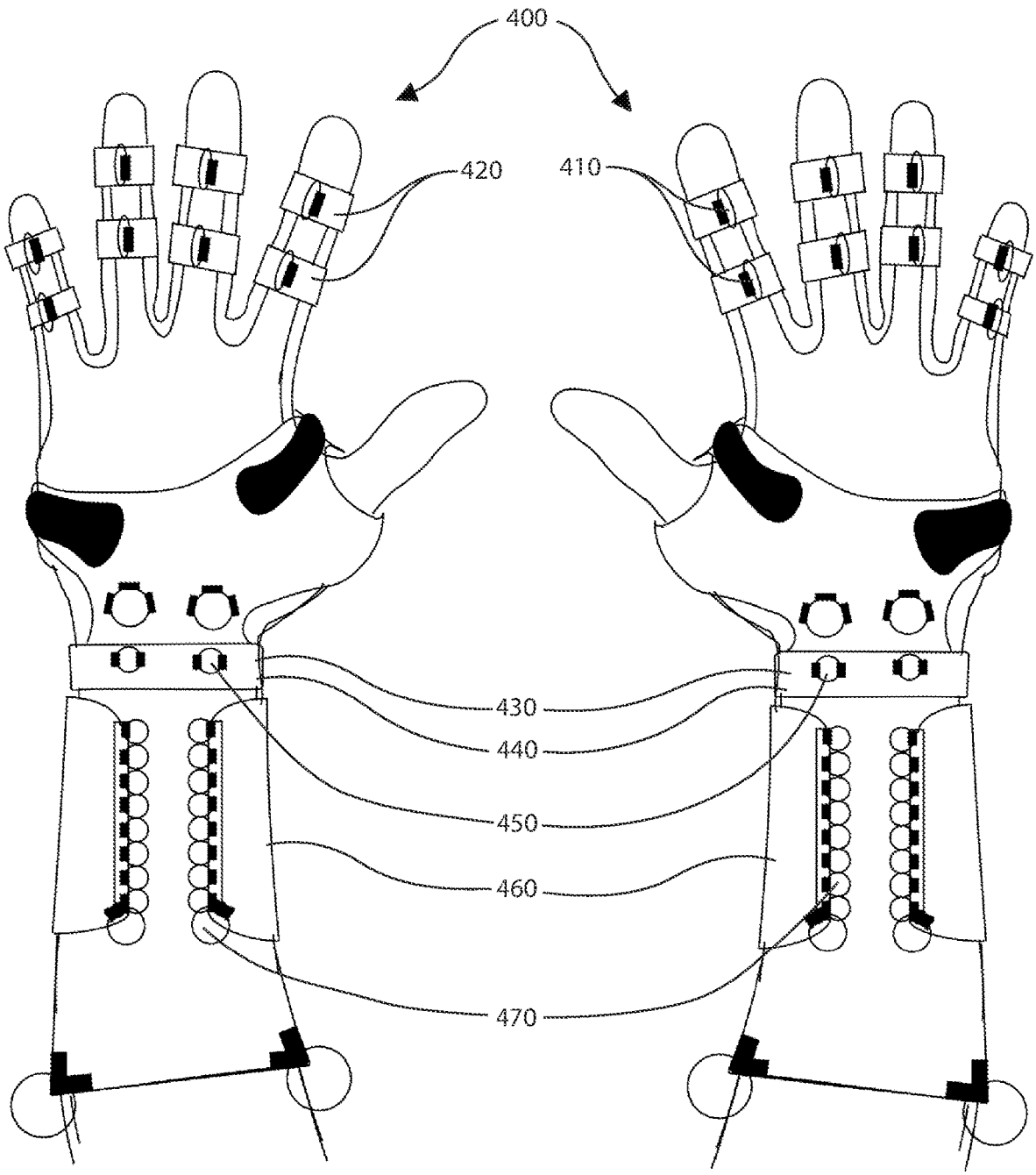
FIG. 16 is an example of a Reversable Krugers with two finger connector rings per finger.

The glove 400 can also have a variety of additions to provide more comfort and ease of use. For example, the glove 400 can have at least one padding member, an adjustable wrist support member 430, and an adjustable support sleeve 460. As seen in FIG. 15 the padding member can be one or more, located on the palm, on the sides or even on the dorsal side of the glove 400, all to provide comfort during use. The glove 400 may also have the adjustable wrist support 430. This wrist support 430 provides rigidity at the wrist locally and prevents injury to the wrist. It also helps to focus the exercises away from the wrist and to the focused muscle or muscle. The gloves can also have wrist loop connectors that are a series of looped rings for laces, designed to secure the wrist support member around the wrist. The gloves may also have an additional, durable wrist band that wraps around the wrist support member or even be incorporated with the wrist support member. This wrist band can also have attached rings for lacing and thus provides various tightness's that provide a comfortable and secure fit.

Figure 17:
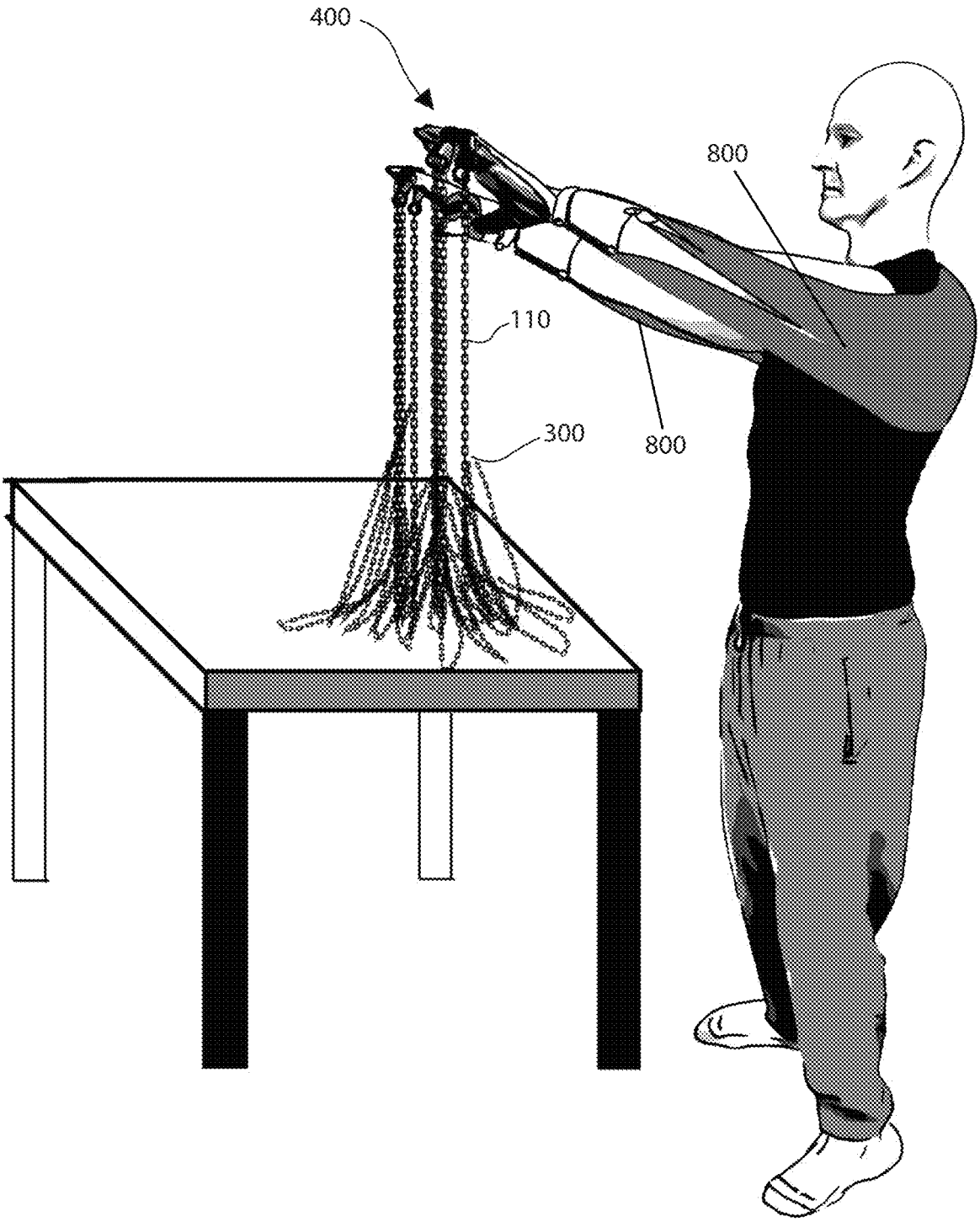
FIG. 17 is an example of the Roberts Smart Chain system in use with a Reversable Kruger in the reverse Kruger exercise position. The Reversable Kruger can be seen using a shoulder harness or sleeve allowing tension to keep the gloves from sliding off so a user may concentrate on exercising the muscles on the back of the arm from the forearm to the shoulder compartment. The user can be seen with fingers extended.
Figure 18:
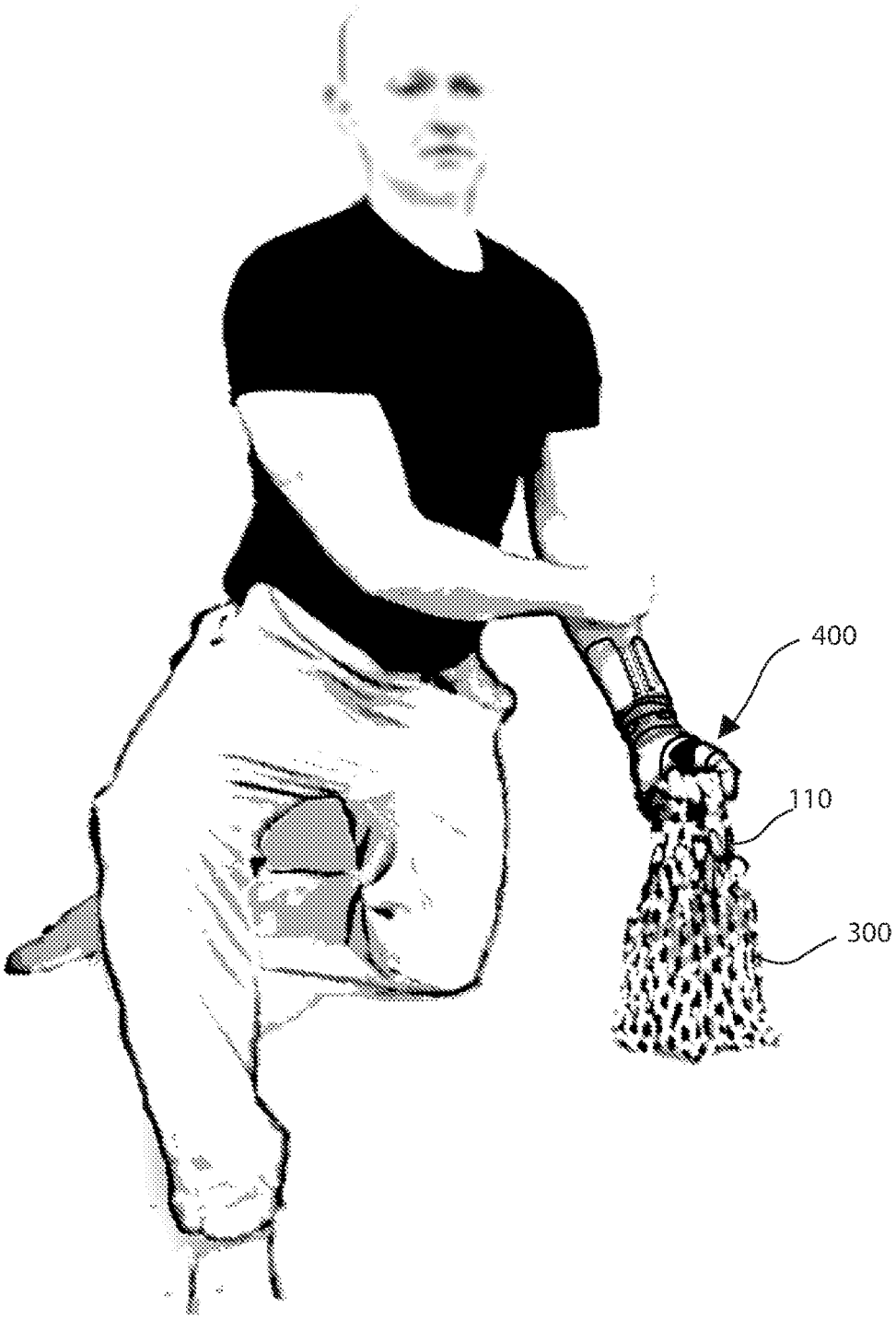
FIG. 18 is an example of the Roberts Smart Chain system in use with a Reversable Kruger in the regular Kruger exercise position targeting the flexor muscles of the forearm with the user kneeling down. The user can be seen with left first contracted.
Figure 19:
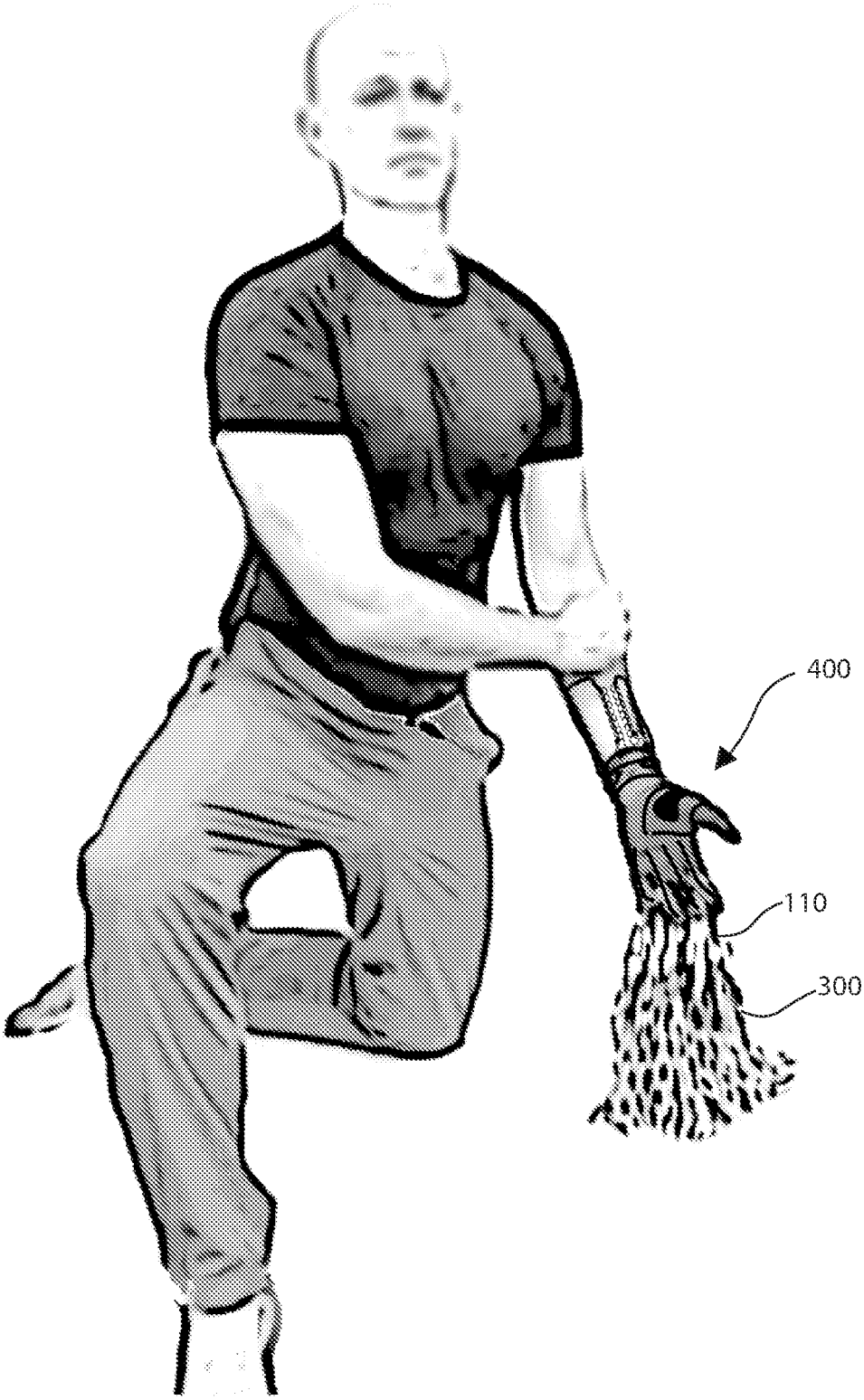
FIG. 19 is an example of the Roberts Smart Chain system in use with a Reversable Kruger in the regular Kruger exercise position targeting the flexor muscles of the forearm with the user kneeling down. The user can be seen with the palm of the left hand open.
Figure 20:
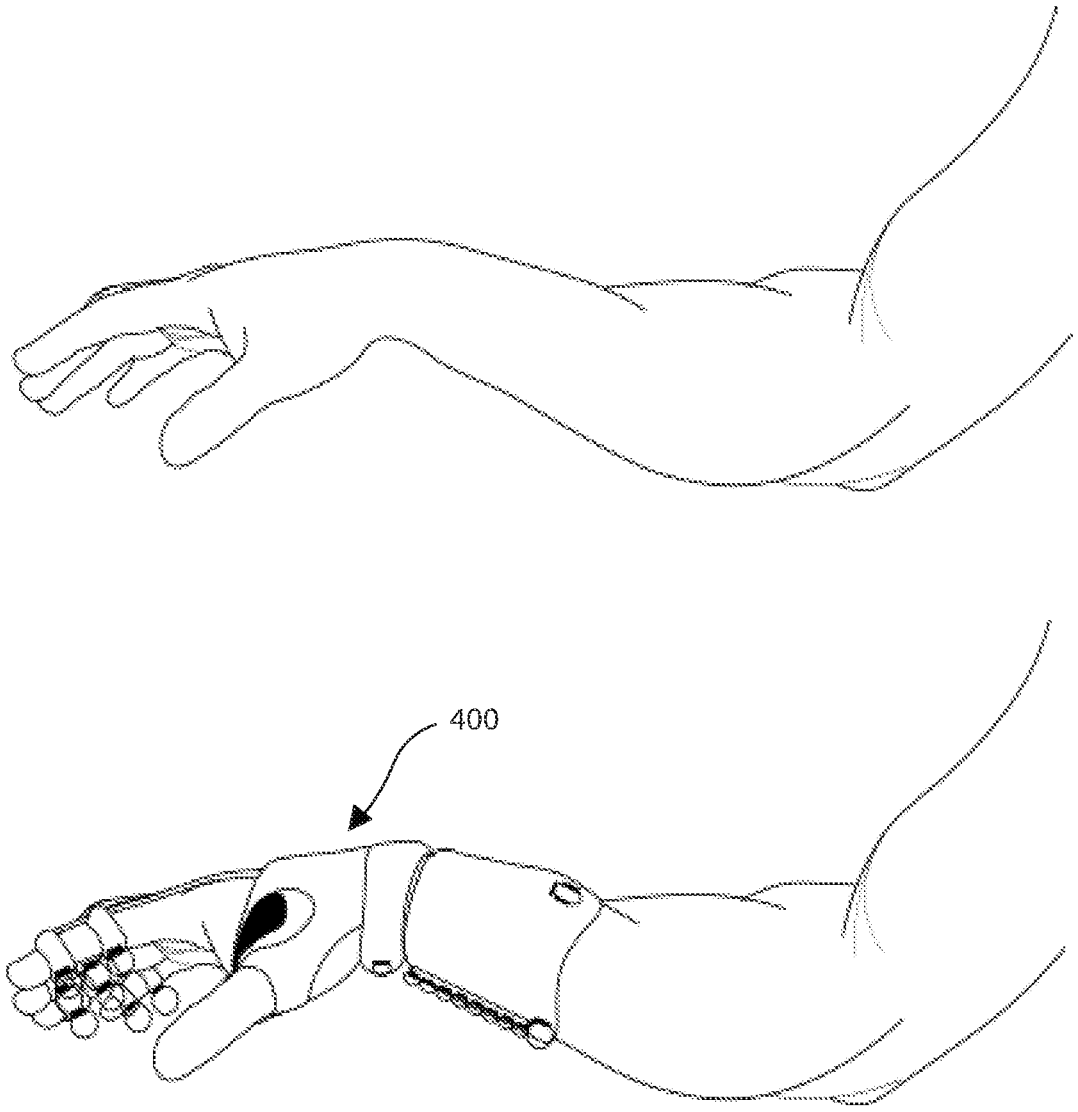
FIG. 20 is a side view of the Reversable Krugers with two finger connector rings per finger.
Figure 21:
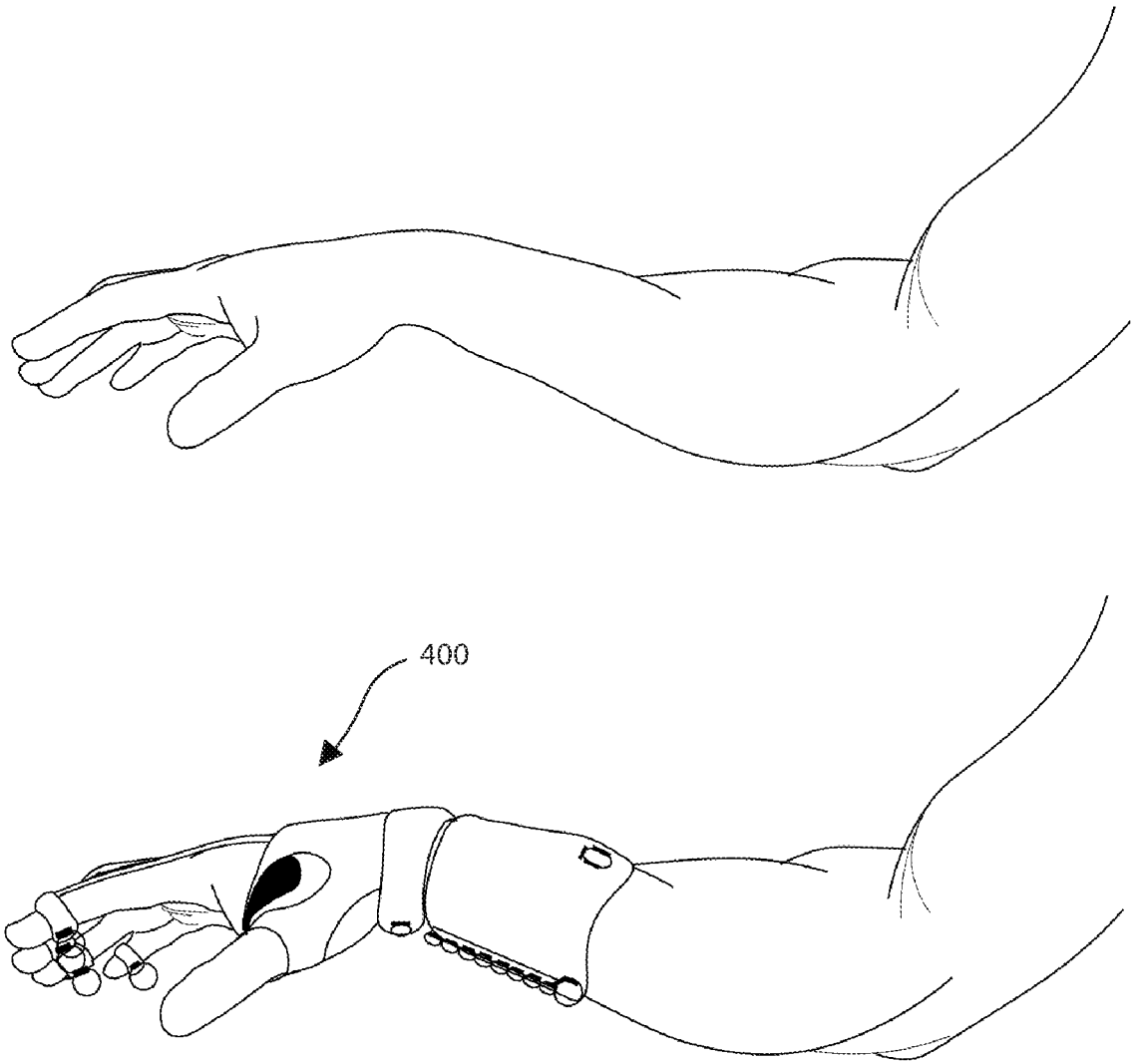
FIG. 21 is a side view of the Reversable Krugers with one finger connector ring per finger.

The support sleeve 460 is shown in FIG. 17 and it can be seen that it extends down from the hand, past the wrist and to the forearm. As with the wrist support 430, the support sleeve 460 provides rigidity to the arm and helps to focus the exercises away from the wrist and forearm and to the focused muscle or muscle. This particularly important when using it to exercise the extensor digitorum muscles so the shoulder compartment is engaged and stable. The durable support sleeve 460 is attached to the long base of the glove. These sleeves may have secured reinforced loops or rings attached directly to the durable supportive sleeve 460 that allow a user to lace up the loops and then tighten the support sleeve 460. This sleeve extends up the arm to more securely hold the gloves in place on the hand.

The Reversible Krugers also may have hook and loop material padding for fit and comfort around the outer side of the hand area attached to padded material that contours the glove for added support and padding. The hook and loop material is adjustable to fit an individual's hand.

In another embodiment the Krugers have a series of Looped rings for securing a shoulder harness 800 for proper leverage as shown in FIG. 17. A connectable shoulder harness 800 is added to attach the gloves to the shoulder harness attachment loops and or rings or attachment features, such that the shoulder sleeve or harness 800 can be used for leverage to more easily pick up the gloves and not have them fall off when using two gloves at once. The shoulder sleeve 800 wraps around the individual and situates for leverage upon the shoulders and across the back of the individual. The shoulder sleeve 800 attached at the connector rings on the glove allows a participant to leverage one's own shoulders to keep tension on the gloves so they have a snug comfort fit allowing the fingers to make the motion required to innervate the deep muscles of the forearms. This application of the Roberts Smart Chain with the extensor digitorums for example accelerates a resistance like no other resistance Chain when easily measurable links are used swiftly to achieved an exercise with Tangents of chain are attached such that can be achieved in a timely manner with easily recordable information using features such as the marked links with Nested Data Cradles easily allowing interface and readability for an individual or a digital device, electronic device or other such machines or technology so as to take measured records more easily.

In a final embodiment there is a weight training apparatus 100, having at least one main chain 110 having a series of interconnected segments 120, at least one connection marker 150 at specified interconnected segments 120 on the at least one main chain 110, at least one tangent chain 300, at least one tangent chain connector 310 to connect the at least one tangent chain 300 to the at least one main chain 110, at least one high gauge glove 400 where the at least one glove 400 is connectable to and operational with the at least one main chain 110, at least one finger 405 on the at least one high gauge glove 400, at least one finger connector 410 attached to and extending from a top of the at least one finger 405, at least one finger connector connecting member 420, where the at least finger connecting member 410 is connectable to the at least one finger connector connecting member 420 and to the at least one main chain 110, at least one data hub 210, at least one data processor 220, and at least one data communicator 230. This embodiment contains all the elements of the first embodiment with data collection and includes the Kruger gloves 400 for other muscle groups of the second embodiment.

As described in the first embodiment using the data collection, in a preferred embodiment, the weight training apparatus 100 has the at least one data hub 210 and the at least one data hub 210 is located at the at least one connection marker 150. Preferably there are more than one connection marker 150 and there are more than one data hub 210, and each data hub 210 is located at each of the connection markers 150. These data hubs 210, as described above, can be extremely simple, non-digital data conveyors, such as the Micro Plaque that contains written information, they can be color or shape coded, or any other type of data communicator that conveys information to the user. On the other hand, they can be simple digital devices such as a readable QR code, or complex digital devices. In one embodiment they are data coded with preloaded data that provides a variety of information. This information could include the data hub's location along the main chain 110 and the chain's weight at a specific location. It could even identify the finger to which finger it is attached, specific finger strength, or other muscle strength. It could also include other preloaded data such as specific user identifying information such as name, date of birth, weight, height, and other previously stored or uploaded training information, training goals, specific weight or repetition goals, or any other information to assist the user with lifting, and more generally, training and health. In addition to this preloaded data the data hub can actively collect data when the user is lifting. This data could include time of day, location, such as at the gym or at the user's home, duration of the workout, number of repetitions performed, number of additional tangents added during the lift, and any other useable information. Ideally the data hub 210 can communicate with other data hubs 210 so that data communicated to the data processor 220 is accurate, precise, and comprehensive. For example, if two tangent chains 300 are added then the two data hubs 210 communicate to convey to the processor that in fact two tangent chains 300 rather than just one tangent 300 was added to the system.

There are wide variety of ways to connect, attach, or build the data hubs 210 into the system. One way to do this is to have a nested data cradle 200 built into the main chain 110 and into each tangent chain 300, as shown in FIGS. 2, 4A, 4B, 5A and 5B. It is also possible to add data hubs 220 to the Kruger gloves 400, thus providing even more detailed information to the user. In one embodiment there is a nestable data cradle 200 for securing the data hub 210 within the recessed, carved out areas, either on the main chain 110, the tangent chains 300 or at a location on the Kruger gloves 400, so as to house, hold and secure the data hub 210 or data hubs 210. These data hubs 210 can be any shape but in this embodiment they are long, rounded on one side and convex on the other and oblong overall. Oval, or oblong shaped so as to pair, or mate, or fit into an oblong or oblong recessed, nested data cradle 200 placed within the center of the outside surface of the interconnected segment 120 links along the Roberts Smart Chain 100 and the tangent chains 300. In other words, a cradle or recess is hollowed out of part of the chain link to provide a storage space within the link itself. The data hub 210 is then securely affixed, lodged and secured within the storage space. Ideally a protective surface member 240 or coating is added on top to cover and protect the data hub underneath.

An alternative to embedding the data hubs within the interconnected segments is to have the data hubs affixed to the outside of the interconnected segment. It could be as simple as a small device that is affixable to the chain with a clip, small snap, an adhesive or any other means to secure the hub to the chain system.

As stated above, recording written lifting data is time consuming at best and extremely inaccurate at worst. Thus, there is a need to have a way to automatically capture, record, store and compare exercise data. Currently several smart devices can measure walking distance, speed or pace, distance, hiking distance and trail courses, elevational gain or loss, heart rate, pulse, oxygen levels, just to mention a few. However, there does not exist a way to measure weightlifting using the current system. The ability to have the Roberts Smart Chain user's digital information conveyed, compared or transferred is simplified by using information through, but not limited to, symbols used in a non-digital system, and now through digital and electronic technologies.

In operation, these data hubs 210 take the previously stored data, combine it with any newly acquired data, and send the compiled data to the data processor 220. This data processor 220 can be located within the same nesting cradle 200, it could be at a computer designed specifically for the lifting system and located at or on the chains themselves or at a computer near the chains, or it could be the user's personal computer or laptop. Alternatively, in a preferred embodiment, this processor is a smart phone, or augmented reality device, such as smart glass, or personal tablet device. In this smart phone, tablet embodiment, there is an application that is downloaded to the user's smart device 235. Then the smart device acts as the data processor 220. The app cooperates and works in communication with the smart device 235 to compile the collected data and to output user friendly data. This data could include weight lifted, added weight lifted, number of reps per work out, number of reps total, gains or losses in muscle mass or strength based on accumulated information, and a wide variety of other information that could be collected and presented to the user. Ideally this new information is compiled with other health data already present on the smart phone and then continually updated with new data from all health applications on the device. Smart phone devices have already achieved some success in this area and as technology advances these systems will only get better. This information after compilation is presented to the user. In one embodiment with an onsite computer, it is shown on a screen at the local, onsite computer. In the smart device 235 application it is presented on the smart device 235. In addition, the information could be presented on a smart watch that either works in conjunction with the smart device 235 or even on its own. This information can be stored either on the smart watch, on the smart phone, smart device 235, on a computer or in the cloud. With the ever-changing technological applications for health the methods and means for storing and collecting this information is ever changing and is not limited to the description presented here.

Although the invention has been described with reference to the preferred embodiments illustrated in the attached drawing figures it is noted that equivalents may be employed and substitutions made herein without departing from the scope of the invention as recited in the claims.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The invention claimed is:

1. A weight training apparatus comprising:
at least one main chain having a series of interconnected segments;
at least one connection marker at specified segments on said at least one main chain;
at least one tangent chain;
at least one tangent chain connector to connect said at least one tangent chain to said at least one main chain;
at least one data hub;
at least one data processor; and
at least one data communicator.

2. The weight training apparatus of claim 1, where said at least one data hub is located at said at least one connection marker and where said at least one data hub is data coded with preloaded data.

3. The weight training apparatus of claim 2, where:
said at least one main chain is made from metal; and
said metal at said at least one connection marker is marked with an identifier.

4. The weight training apparatus of claim 2, where said at least one data hub:
is non-digital;
contains data that is communicable to a user;
said user is configured to receive and process said data; and
said at least one data communicator is also non-digital.

5. The weight training apparatus of claim 2, where:
said at least one data hub:
is digital;
has imbedded identification data; and
collects data;
said at least one data processor:
is digital;
compiles data; and
then sends compiled data to said at least one data communicator.

6. The weight training apparatus of claim 5, where said at least one data communicator is a part of said weight training apparatus.

7. The weight training apparatus of claim 5, where said at least one data communicator is a smart device.

8. The weight training apparatus of claim 1, where said at least one connection marker is located at a link in multiples.

9. A weight training apparatus, comprising:
at least one main chain having a series of interconnected segments;
at least one connection marker at specified segments on said at least one main chain;
at least one tangent chain;
at least one tangent chain connector to connect said at least one tangent chain to said at least one main chain;
at least one glove; where
said at least one glove is connectable to and operational with said at least one main chain.

10. The weight training apparatus of claim 9, where said at least one glove further comprises:
at least one finger;
at least one finger connector attached to and extending from a top of said at least one finger;
at least one finger connector connecting member; and where
said at least one finger connector connecting member is connectable to said at least one finger connector and to said at least one main chain.

11. The weight training apparatus of claim 10, where said at least one glove further comprises:
at least one padding member;
an adjustable wrist support member; and
an adjustable support sleeve.

12. The weight training apparatus of claim 11, further comprising:
a shoulder harness connectable to said at least one glove.

13. A weight training apparatus, comprising:
at least one main chain having a series of interconnected segments;
at least one connection marker at specified segments on said at least one main chain;
at least one tangent chain;
at least one tangent chain connector to connect said at least one tangent chain to said at least one main chain;
at least one glove; where
said at least one glove is connectable to and operational with said at least one main chain;
at least one finger on said at least one glove;
at least one finger connector attached to and extending from said at least one finger;
at least one finger connector connecting member; where
said at least finger connector connecting member is connectable to said at least one finger connector and to said at least one main chain;
at least one data hub;
at least one data processor; and
at least one data communicator.

14. The weight training apparatus of claim 13, where said at least one data hub is data coded with preloaded identifying data.

15. The weight training apparatus of claim 14, where said at last one connection marker is marked with an identifier.

16. The weight training apparatus of claim 15, where said at least one data hub:
is non-digital;

has preloaded imbedded data that is communicable to a user;

said user is configured to receive and process said data; and said at least one data communicator is non-digital.

17. The weight training apparatus of claim 15, where:

said at least one data hub:

is digital;

has preloaded imbedded data;

is configured to collect data; and is configured to send imbedded data and collected data to said at least one data processor;

said at least one data processor:

is digital;

can compile data;

can send data to said at least one data communicator; and said at least one data communicator can convey compiled data to said user.

18. The weight training apparatus of claim 17, where said at least one data communicator is:

securely nested in a cradle in said at least one main chain or in said at least one tangent chain; and is located at specified positions along said at least one main chain.

19. The weight training apparatus of claim 17, where said at least one data processor and said at least one data communicator is a computer or is built into said weight training apparatus.

20. The weight training apparatus of claim 17, where said at least one data processor and said at least one data communicator are a smart device.

* * * * *